US005819833A

United States Patent [19]

Swiszcz et al.

[11] Patent Number: 5,819,833

[45] **Date of Patent: *Oct. 13, 1998**

[54] CONTROL AND SUSPENSION SYSTEM FOR A VERTICAL VANE COVERING FOR ARCHITECTURAL OPENINGS

[75] Inventors: Paul G. Swiszcz, Boulder; Brad H. Oberg, Westminster; James M. Anthony, Denver; Wendell B. Colson, Boulder; David G. Mateer, Niwot, all of Colo.

[73] Assignee: Hunter Douglas Inc., Upper Saddle River, N.J.

[ * ] Notice: The term of this patent shall not extend beyond the expiration date of Pat. No. 5,626,177.

[21] Appl. No.: 639,905

[22] Filed: Apr. 24, 1996

Related U.S. Application Data

[63] Continuation-in-part of Ser. No. 472,992, Jun. 7, 1995, Pat. No. 5,626,177.

[51] Int. Cl.[6] ..... E06B 9/30

[52] U.S. Cl. ..... 160/168.1 V; 160/167 V; 160/177 V; 160/176.1 V; 160/900

[58] Field of Search ..... 160/166.1 R, 167.1 V, 160/168.1 V, 174, 177, 178.1 V, 176.1 V, 40, 900

[56] References Cited

U.S. PATENT DOCUMENTS

| | | | |
|---|---|---|---|
| 1,468,433 | 9/1923 | Zackow . | |
| 2,503,441 | 4/1950 | Kamm | 160/168.1 V |
| 2,822,043 | 2/1958 | Horak | 160/168.1 V |
| 3,240,260 | 3/1966 | Rabinow | 160/176.1 V |
| 3,280,891 | 10/1966 | Eldredge, Jr. et al. . | |
| 3,851,699 | 12/1974 | Shapiro | 160/900 X |
| 4,122,884 | 10/1978 | Salzmann . | |
| 4,628,981 | 12/1986 | Ciriaci et al. . | |
| 4,779,661 | 10/1988 | Yalowega | 160/178.1 |
| 4,936,370 | 6/1990 | Ueker et al. | 160/168.1 V |
| 5,004,033 | 4/1991 | Stipkovits | 160/178.1 |
| 5,029,365 | 7/1991 | McCabe | 160/900 X |
| 5,088,542 | 2/1992 | Biba et al. | 160/168.1 V |
| 5,249,617 | 10/1993 | Durig | 160/168.1 V |
| 5,289,863 | 3/1994 | Schon | 160/168.1 V |
| 5,351,741 | 10/1994 | Swopes | 160/168.1 V |
| 5,626,177 | 5/1997 | Colson et al. | 160/168.1 V |

FOREIGN PATENT DOCUMENTS

| | | |
|---|---|---|
| 111926 | 6/1984 | European Pat. Off. . |
| 8704057 | 7/1987 | European Pat. Off. . |
| 589846 | 3/1994 | European Pat. Off. . |
| 2362264 | 3/1978 | France . |
| 3048763 | 8/1992 | Germany . |
| 349290 | 5/1931 | United Kingdom . |

*Primary Examiner*—Harry C. Kim
*Assistant Examiner*—Bruce A. Lev
*Attorney, Agent, or Firm*—Dorsey & Whitney LLP

[57] ABSTRACT

A control system for a vertical vane covering for use in an architectural opening includes a headrail having an upwardly opening channel in which a plurality of carriers are disposed for sliding movement along the length of the headrail. The headrail is of a thin profile with only a minority portion of the carriers being positioned within the hollow interior of the headrail. The carriers are interconnected by a scissors-type linkage to effect uniform separation of the vanes when the covering is expanded across an architectural opening and each carrier includes a rack and pinion system for rotating the vanes suspended thereby. Unique mountings for the endmost vanes allow the endmost vanes to cover the ends of the headrail.

41 Claims, 18 Drawing Sheets

16
16
24
26
28
32
34
42
44
48
54
56
58
60
62
66
68
70
72
110
116
118
122
142
146
148
160
163
164
168
172
174
178
180
182
30

CONTROL AND SUSPENSION SYSTEM FOR A VERTICAL VANE COVERING FOR ARCHITECTURAL OPENINGS

CROSS REFERENCE TO RELATED APPLICATIONS

This is a continuation-in-part of application Ser. No. 08/472,992 filed on Jun. 7, 1995, U.S. Pat. No 5,626,177.

BACKGROUND OF THE INVENTION

1. Field of the Invention

The present invention relates generally to coverings for architectural openings such as doors, windows and the like, and more particularly to a control system for a covering having a plurality of vertically suspended vanes that are moveable between extended and retracted positions as well as open and closed positions to control visibility and the passage of light through the architectural opening.

2. Description of the Relevant Art

Covers for architectural openings such as doors, windows and the like have been known in various forms for many years. One form of such covering is commonly referred to as a vertical vane covering wherein a control system suspends and is operable to selectively manipulate a plurality of vertically suspended vanes such that the vanes can be moved laterally across the architectural opening to extend or retract the covering and pivoted about longitudinal vertical axes to open and close the vanes.

Control systems for operating vertical vane coverings typically include a headrail in which a plurality of carriers associated with each vane are movably mounted for lateral movement and include internal mechanisms for pivoting the vanes about their vertical axes. The headrails vary in construction and configuration to house the various types of carriers but typically the headrails are relatively large in cross-section to enclose the working components of the system and have a slot along a bottom or side wall through which a portion of each carrier protrudes for connection to an associated vane.

An example of a control system wherein a headrail includes a slot along a side thereof through which a portion of the carriers protrudes is shown in U.S. Pat. No. 4,425,955 issued to Kaucic on Jan. 17, 1984. One problem with headrails having a slot in the side thereof resides in the fact that the slot is visible in the room in which the system is mounted and therefore is aesthetically unattractive.

U.S. Pat. No. 4,361,179 issued to Benthin on Nov. 30, 1982 discloses a headrail having an opening through the top thereof so as to improve the aesthetics of the headrail. The primary components of each carrier in the system are confined within the interior of the headrail and generally C-shaped hangers associated with each carrier circumscribe the headrail so as to be in a position to support an associated vane from beneath the headrail. The Benthin patent accordingly acknowledges the desire of having the opening in the headrail concealed from normal view. The drawback with a system of the type disclosed in the Benthin patent resides in the fact that a majority of the working components of each carrier is confined within the headrail thereby necessitating a headrail with a fairly large cross-section which in and of itself is aesthetically unattractive.

A patent of interest from the standpoint of minimizing the size of the headrail is U.S. Pat. No. 2,869,636 which shows a relatively thin headrail having a slot in a rear wall thereof through which each carrier projects and wherein most of the carrier components are disposed outside the headrail. The headrail, while being relatively small, is oval in configuration with the broad side of the oval facing the interior of the room in which the system is mounted so as to undesirably present a relatively large profile.

As will be appreciated, while the prior art includes many different forms of control systems and headrails in which various types of carriers are movably mounted, they each suffer from aesthetic drawbacks related either to the size of the headrail as it is presented to the interior of the room in which the system is mounted or to the visibility of slots provided in the headrail. Further, most prior art systems are noisy in operation rendering them undesirable for that reason as well.

It is to overcome the shortcomings in prior art systems and to provide a new and improved control system that is easy to operate, quiet in operation and aesthetically pleasing that the present invention has been made.

SUMMARY OF THE INVENTION

The control system of the present invention is adapted for use in a covering for an architectural opening and includes a very thin profile headrail which is aesthetically attractive and a plurality of carriers supported by the headrail for independently supporting and pivoting connected vanes used in the covering. The carriers project through an opening in the top of the headrail which does not detract from the appearance of the covering. The carriers are interconnected by a scissors-type linkage so that the vanes suspended by the carriers can be stacked adjacent one or both sides of an architectural opening when the covering is retracted but are uniformly spaced when the covering is extended to cover the architectural opening. The scissors-type linkage is disposed above the headrail and is also of a very thin profile so as not to be a detriment to the aesthetics of the system. A lead one of the carriers is connected to a traverse cord and is moveable by the cord longitudinally of the headrail or transversely of the opening in which the architectural covering is mounted and movement of the lead carrier causes the remaining follower carriers to move therewith.

Each carrier is mounted on the headrail for smooth and quiet sliding movement and includes a rack and pinion system for pivoting a suspended vane. The rack and pinion system is operatively engaged with a tilt rod that runs the length of the headrail. The tilt rod is mounted for rotative movement about its longitudinal axis such that a manually operable tilt cord or wand disposed at one end of the headrail can selectively rotate the tilt rod in either rotative direction to reversibly effect pivotal movement of the vanes about their vertical longitudinal axes.

The tilt rod is star shaped in cross section having a plurality of radially directed longitudinally extending teeth that engage a first set of teeth on a rack in each carrier such that rotative movement of the tilt rod effects translative or linear movement of the rack. A pivotal hanger pin in each carrier, which supports an associated vane, has a pinion gear adapted to operatively engage teeth on the rack so that translative movement of the rack causes pivotal movement of the carrier pin and consequently the vane connected thereto.

The components of the carriers are made of a low coefficient of friction plastic material and are configured in such a way that the contact area of the carriers with the headrail is minimized whereby the relative movement of the component parts is very quiet and smooth as is the sliding movement of the carriers along the length of the headrail.

While the tilt rod is preferably made of a metal material, its engagement with the low coefficient of friction plastic is likewise very quiet so that the entire mechanism is relatively noiseless in operation.

Each carrier has only a minority portion thereof disposed within the hollow trough-like interior of the headrail so that the headrail can be of a thin profile. The remainder of each carrier is disposed above the headrail and overhangs a front side of the headrail. All of the visual components of the carrier are of thin dimension so as to present a thin profile from inside the room in which the system is mounted.

As will also be appreciated, since the bottom of the headrail is closed, thereby hiding many of the working components of the system from the interior of the room where it is mounted, the bottom of the headrail prevents any working components from sagging, due to gravity, below the headrail.

The system further includes unique components for connection to the endmost vanes so that the covering can uniquely wrap around the ends of the headrail in a neat and attractive manner.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
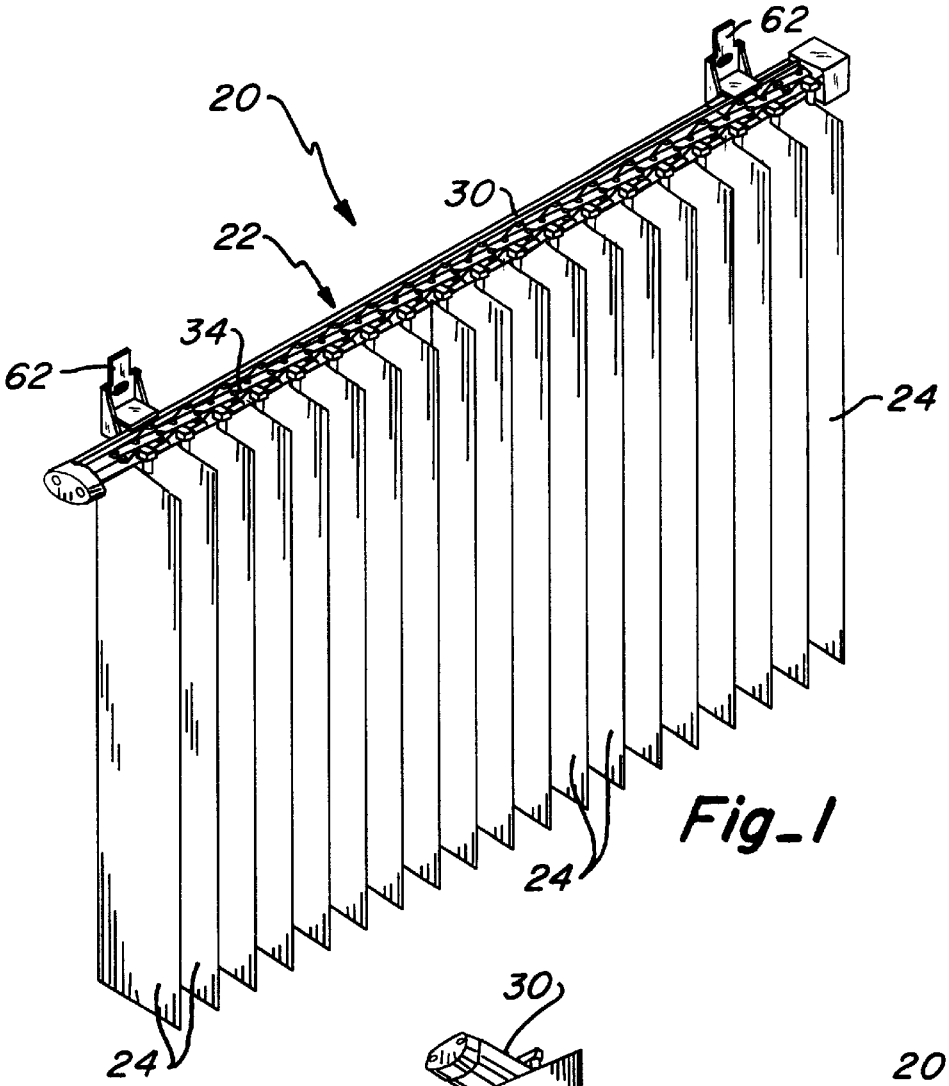
FIG. 1 is an isometric view looking down on the control system of the present invention in use in connection with a covering for an architectural opening.
Figure 2:
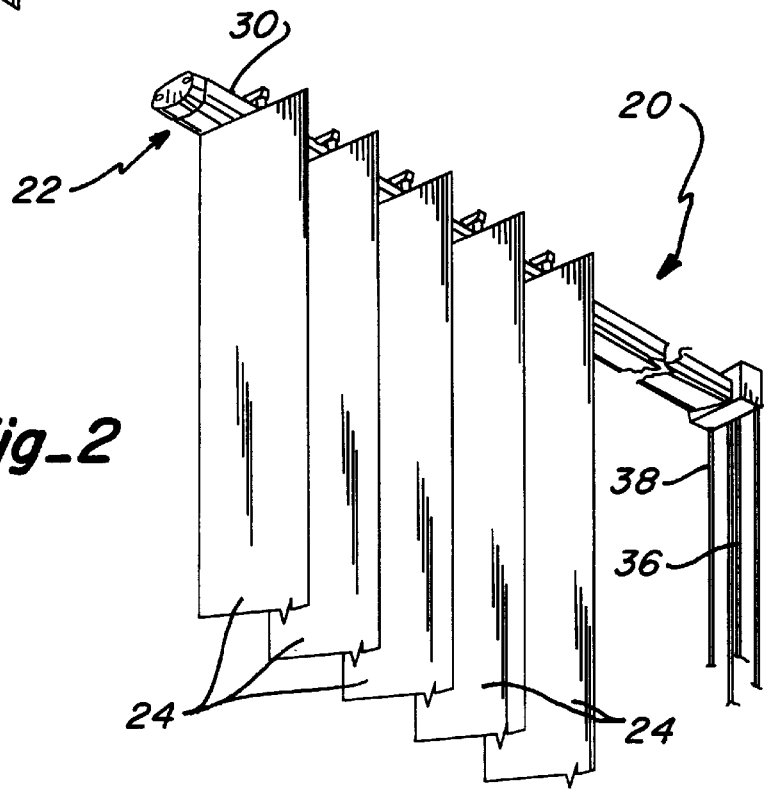
FIG. 2 is a fragmentary isometric view looking upwardly at the covering.

A covering 20 for an architectural opening incorporating the control system 22 of the present invention is seen best in FIGS. 1 and 2 to include not only the control system but also a plurality of vertically suspended side-by-side vanes 24. While such a covering finds numerous uses in various architectural openings such as doors, windows, archways and the like, it will be referred to as a window blind or covering for purposes of the present disclosure.

Vanes 24 used in vertical vane window blinds can take many different forms, but, for purposes of the present disclosure, the vanes are illustrated as being flat planar sheets of rectangular configuration each having a reinforcing tab 26 (FIGS. 7 and 11) of plastic material or the like centrally located along a top edge with the tab projecting upwardly from the top edge and having an opening 28 therethrough to assist in its attachment to the control system.

The control system 22 itself generally includes a headrail 30, a plurality of carriers 32 from which the vanes 24 are individually suspended, a linkage 34 interconnecting the carriers and control cords 36 and 38 for manipulating the carriers 32. The carriers are slidably movable along the length of the headrail so as to move the blind between extended (FIG. 1) and retracted (FIG. 5) positions and each individual carrier includes a system for pivotally moving an associated vane between open (FIG. 3) and closed (FIG. 4) positions. In the open position of the vanes, they extend perpendicularly to the architectural opening while in the closed position they extend substantially parallel to the opening and in overlapping relationship with each other. In the closed position the vanes substantially block visibility and the passage of light through the opening. The control system 22 can be adapted to move all of the vanes from the extended position to a retracted position adjacent one side of the opening or adjacent complementary control systems can be utilized so that half of the vanes are retracted to one side of the opening while the other half are retracted to the opposite side. The latter result can also be obtained with suitable modifications to a single control system of the type described hereafter as would be apparent to one skilled in the art.

Looking particularly at the headrail 30 as seen best in FIGS. 1, 2, 6A, 7 and 11, it can be seen to be a generally U-shaped trough-like member opening upwardly so as to define in cross-section, an open top side 40, a bottom wall 42 and inner and outer upstanding legs 44 and 46 respectively. The bottom wall 42 is slightly downwardly convex having a downwardly opening groove 48 established at the base of the inner leg 44. Each of the inner and outer legs has an enlarged head 50 and 52 respectively extending the length of the headrail with an upwardly opening groove 54 and 56 respectively. Intermediate the bottom wall 42 and the head 50 on the inner leg is an internal groove 58 that opens in a direction away from the supporting surface 60 on which the headrail is mounted. While the headrail could be made of various materials, it has been found that an extruded aluminum that is painted with a low coefficient of friction paint provides an ideal surface for smooth and quiet operation of the system in a manner to be described later. A paint manufactured by Morton International of Decatur, Ala., and sold under Polyceram Model No. 1400 has been found to be ideally suited for use on the headrail.

Figure 7:
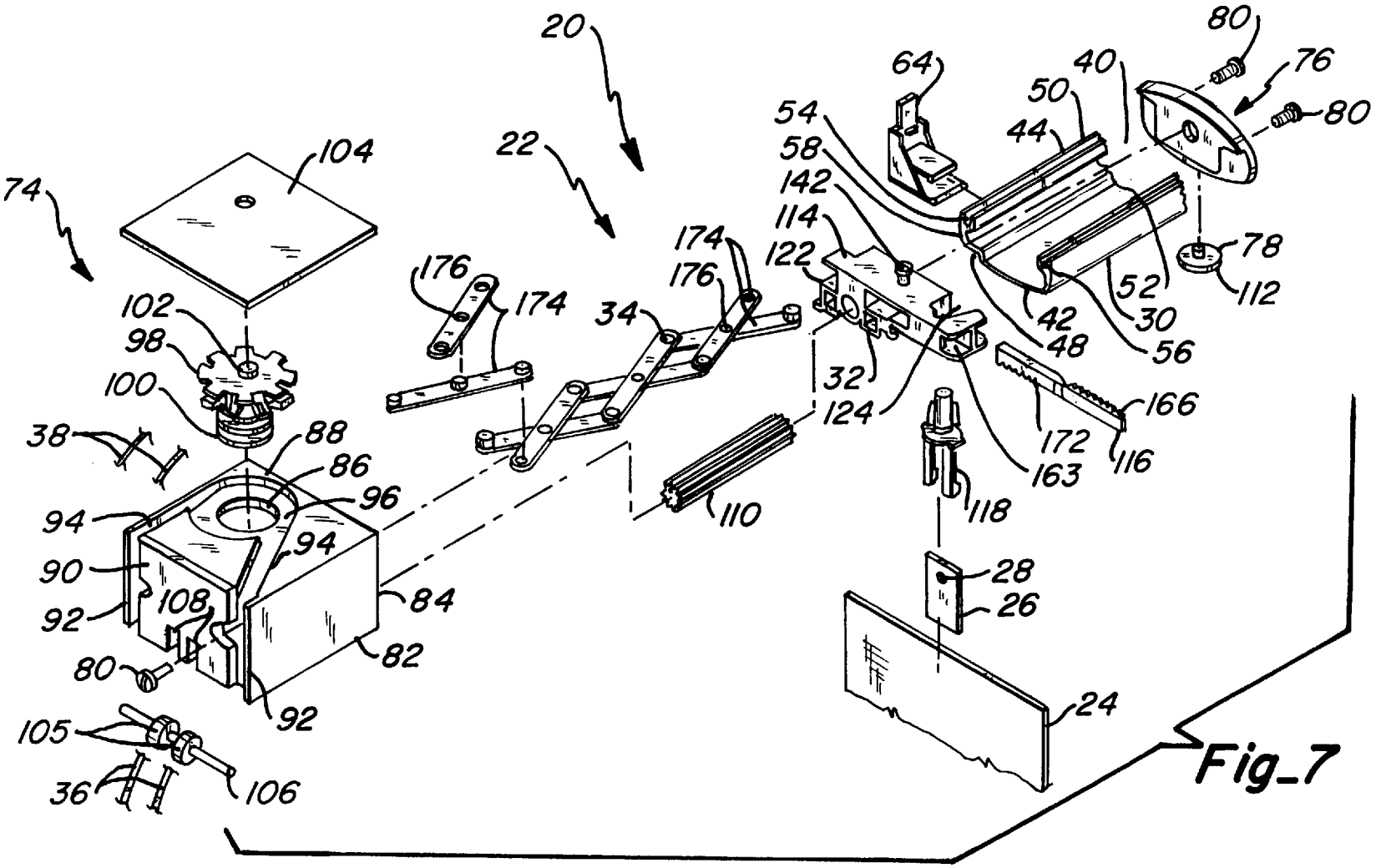
FIG. 7 is fragmentary exploded isometric showing the various components of the covering of FIG. 1.
Figure 25:
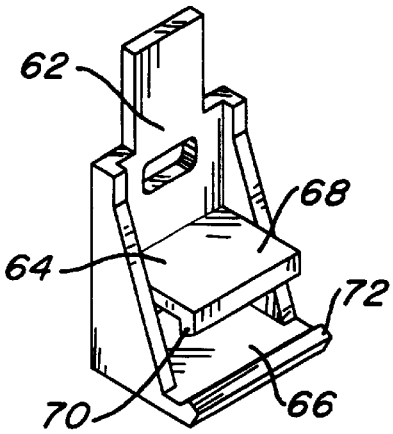
FIG. 25 is an isometric view of a bracket for hanging the headrail on a supporting surface.

The headrail 30 is suspended from the support surface 60 by a plurality of horizontally spaced mounting brackets 62, best seen in FIGS. 1, 7 and 25, secured to the support surface and having a main body portion 64 and upper and lower vertically spaced substantially horizontally disposed plate-like legs 66 and 68 respectively having in-turned lips 70 and 72 respectively. The lip 72 on the lower leg projects into the groove 48 formed in the bottom wall 42 of the headrail and the lip 70 on the upper leg projects into the upwardly opening groove 54 in the head 50 of the inner leg of the headrail. As will be appreciated by reference to FIGS. 1 and 11, the headrail is thereby supported and suspended in a releasable manner by the brackets so as to present a very thin profile into the interior of the room in which the system is mounted and such that the open side of the headrail is directed upwardly.

Primary and secondary end caps 74 and 76 respectively, best seen in FIG. 7, are provided on the ends of the headrail 30 with the primary end cap 74 including pulley systems for operative engagement with the traverse cord 36 and the tilt cord 38 for manual manipulation by an operator of the system. The secondary end cap 76 is a substantially hollow body having an idler pulley 78 disposed therein for operative engagement with the traverse cord as will be described in more detail hereafter. The primary and secondary end caps are secured to the ends of the headrail in any suitable manner such as by screw type fasteners 80 as seen best in FIG. 7.

The primary end cap 74 consists of a block 82 of plastic or other suitable material having a large recess (not seen) in an inner side 84 facing the headrail 30. A vertical bore 86 passes downwardly from a top wall 88 of the block into communication with the large recess. An outer wall 90 on the opposite side of the block from the headrail has a pair of parallel, vertical grooves 92 which define channels in which the tilt cord 38 is disposed. The vertical grooves 92 are continuous with a pair of convergent grooves 94 in the top wall of the block which are in turn continuous with an arcuate groove 96 passing around the vertical bore in the block. Rotatably disposed within the vertical bore in the block is a positive-grip pulley 98 having a worm gear 100 integrally depending therefrom. An integral vertical shaft 102 extends above the pulley and below the worm gear. The shaft is journaled at a lower end within the large recess and at the upper end in a top cover plate 104 to permit reversible rotative movement of the pulley and worm gear. The pulley is positioned adjacent the top wall 88 of the block and in alignment with the grooves 94 and 96 for the tilt cord so that the tilt cord can pass around the pulley in gripping engagement therewith whereby movement of the tilt cord in either direction causes a corresponding rotative movement of the positive-grip pulley. The ends of the tilt cord hang from the primary end cap and may be secured together to form an endless loop for ease of operation.

Mounted within the large recess in the block are a pair of vertically oriented pulleys 105 (FIG. 7) rotatably mounted on opposite ends of a horizontal shaft 106. The pulleys are aligned with a pair of openings 108 in the outer wall 90 of the block so that the traverse cord 36 passing through the openings in the outer wall can extend across the pulleys as will be explained in more detail later.

The large recess in the primary end cap 74 further includes a journaled bearing (not seen) for supporting one end of a tilt rod 110 having longitudinally extending circumferentially spaced teeth that mesh with the worm gear 100. The tilt rod extends the length of the headrail 30 with the opposite end of the tilt rod being journaled and supported in the secondary end cap 76 at the opposite end of the headrail. The secondary end cap further has mounted interiorly thereof on a vertical shaft a horizontally disposed rotatable pulley 112 (FIG. 7) around which the traverse cord 36 extends before returning to the primary end cap 74.

Figure 6:
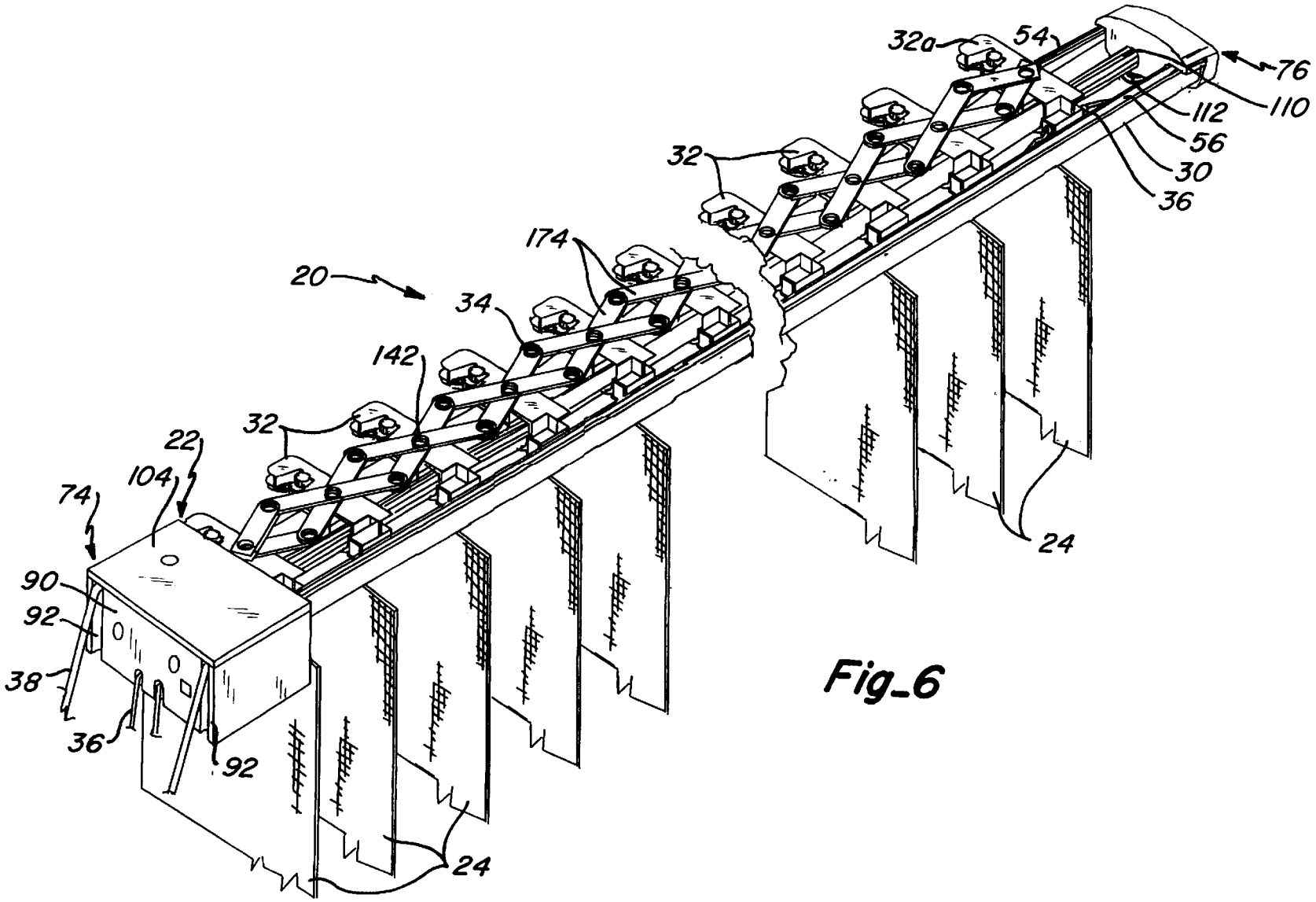
FIG. 6 is an enlarged fragmentary isometric similar to FIG. 1 looking down on the covering.
Figure 6A:
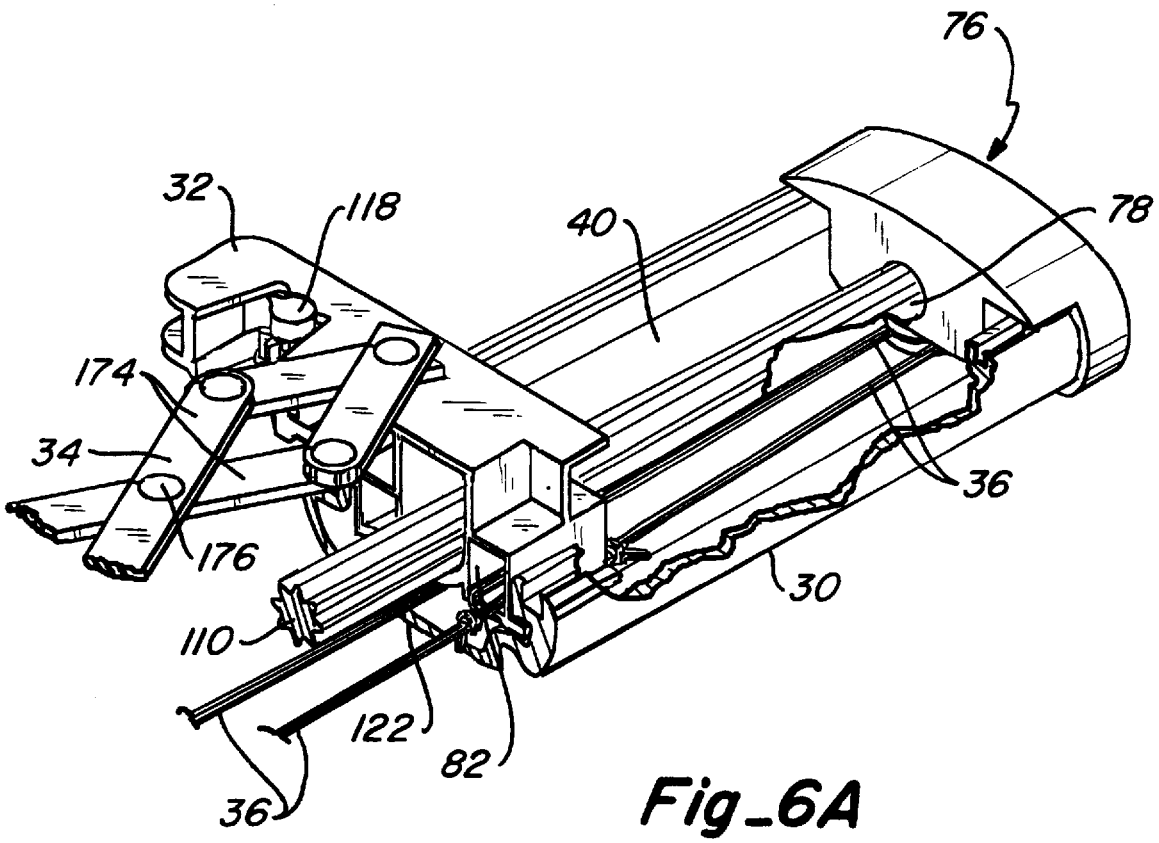
FIG. 6A is an enlarged fragmentary isometric of the end of the headrail having the secondary end cap.

As best seen in FIG. 6A, the traverse cord 36 is an elongated length of cable or cord which has a first end inserted into one of the openings 108 in the outer wall 90 of the primary end cap and is extended along the length of the headrail 30 to the secondary end cap where it is passed around the pulley 112 and returned to the headrail. The end of the cord 36 is ultimately secured to a lead carrier 32A as will be described later. The opposite end of the traverse cord 36 is fed into the second opening 108 in the outer face 90 of the primary end cap and subsequently into the headrail where it too is secured to the lead carrier 32A. It will be appreciated that the traverse cord thereby forms an endless loop with the lead carrier integrated therein such that movement of the cord in either direction causes the lead carrier to slide along the length of the headrail.

Figure 20:
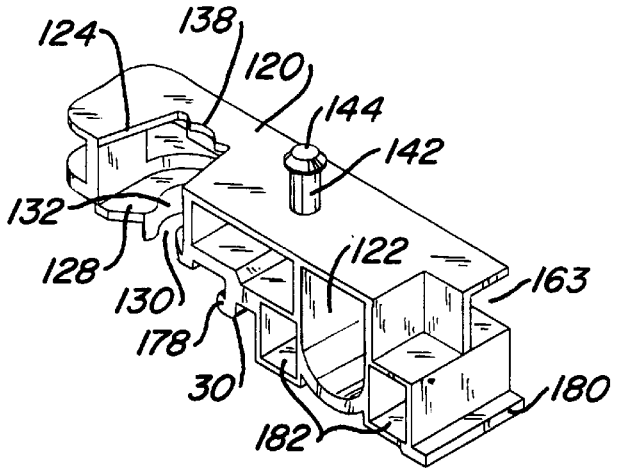
FIG. 20 is an isometric view of a carrier body looking down on the body.
Figure 21:
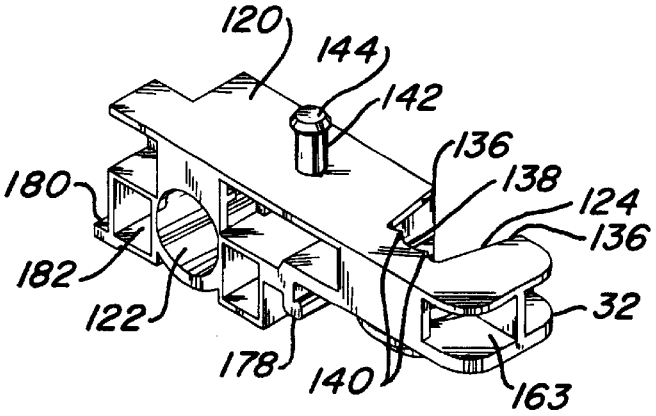
FIG. 21 is an isometric view similar to FIG. 20 looking down on the carrier body from a different direction.
Figure 22:
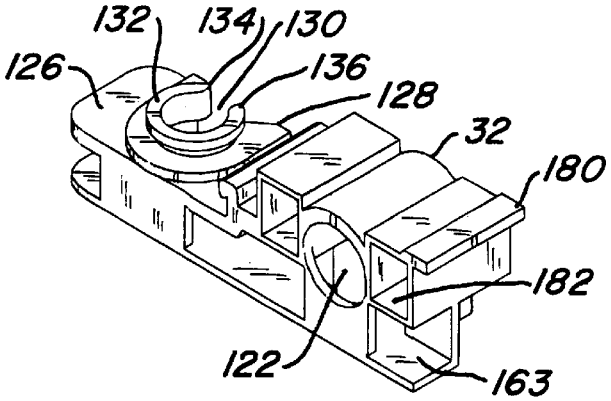
FIG. 22 is an isometric view similar to FIG. 20 looking at the carrier body from the bottom.

Each of the carriers 32, as best seen in FIGS. 7, 11, 13 and 20–24, are identically formed and configured and include a carrier body 114, a rack 116 and a hanger pin 118. The carrier body, which is probably best seen in FIGS. 20–22, is preferably injection molded from a low coefficient of friction plastic material such as Celcon® manufactured by Hoechst Celanese Corporation of Chatham, N.J., and has a relatively flat top wall 120 underneath which are formed a number of passages or notches between various walls or partitions. At one end of the body 114 adjacent a lower portion thereof is a transverse passage 122 of substantially cylindrical configuration. The passage is slightly larger in diameter than the tilt rod 110 and is adapted to rotatably receive the tilt rod. The opposite end of the body 114 has a laterally opening notch 124 formed therein with the notch being defined between the top wall 120 of the carrier body and a bottom wall 126. The bottom wall has a generally U-shaped integral flange 128 in underlying relationship to the notch formed in the bottom wall with the flange having a relatively narrow neck portion 130 and a larger interior portion 132. Legs 134 defined on the flange at the neck portion 130 will yield to temporarily permit enlargement of the neck portion. The opening in the top wall 120 defined by the notch has a pair of convergent edges 136 and an end edge 138. The end edge is scalloped so as to define a pair of horizontally spaced stops 140. The stops perform a function which will be described later in connection with the description of the hanger pin.

The top wall 120 further has a centrally located upstanding cylindrical pin 142 with an enlarged frusto-conical head 144 adapted to connect the carrier body 114 to the linkage system 34 as will be described later.

Figure 23:
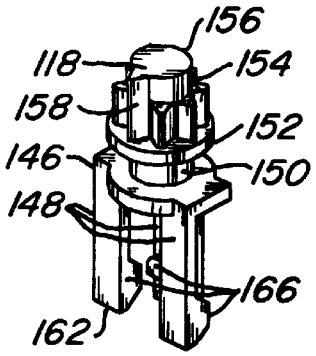
FIG. 23 is an isometric view of a hanger pin placeable in the carrier body of FIG. 20.

As best seen in FIG. 23, the hanger pin 118 has a horizontal plate portion 146, three confronting pins 148 depending from the plate portion defining a slot therebetween, and a cylindrical body 150 above the plate portion which supports thereabove on an enlarged disc-like portion 152 a pinion gear 154. Above the pinion gear, an integral cylindrical body 156 protrudes upwardly having a radial abutment finger 158 adapted to cooperate with the stops 140 on the top wall of the carrier body 114 as will be described later.

The hanger pin 118 is releasably connected to the carrier body 114 so as to be pivotal about a vertical axis. The cylindrical body 150 of the hanger pin is of slightly larger diameter than the neck portion 130 in the flange 128 on the main body but as mentioned previously, the legs on the flange are resilient so as to allow the cylindrical body of the hanger pin to be forced through the neck into the enlarged interior portion 132 of the flange. Once so positioned, the neck portion releasably retains the hanger pin on the carrier body. The enlarged interior portion 132 of the flange is larger than the cylindrical body 150 of the hanger pin to permit free pivotal movement of the hanger pin. When appropriately positioned in the carrier body, the abutment finger 158 on the top of the hanger pin limits pivotal movement of the hanger pin by abutting one stop 140 or the other on the top wall of the carrier body so that the hanger pin, without being forcefully displaced, is only permitted to pivot through slightly more than 180 °.

The three confronting pins 148 that depend from the plate portion of the hanger pin are elongated vertical pins and are somewhat flexible. Each pin has an enlarged head 160 near its lower end and a lower beveled surface 162 so that the reinforcing tab 26 on the top of a vane 24 can be inserted vertically between the three confronting pins until the enlarged head 160 on the center one of the three pins 148 protrudes into the opening 28 in the reinforcement tab. The enlarged heads 160 on the other two pins press into the vane reinforcing tab 26 from the opposite side and thereby hold the head on the center pin in the opening to releasably secure the vane in a depending manner from the hanger pin.

Figure 16:
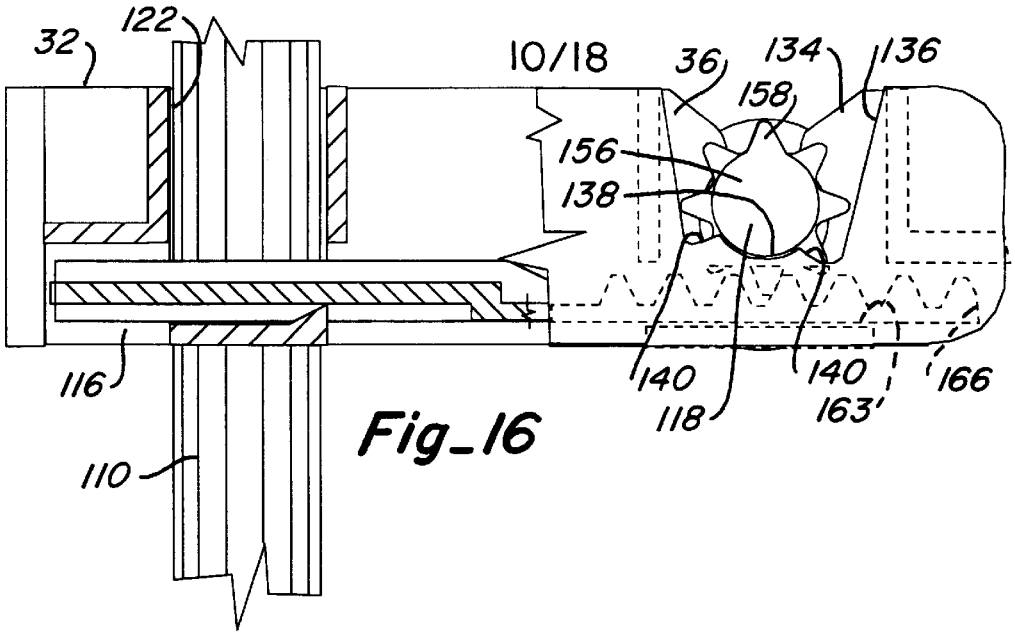
FIG. 16 is an enlarged fragmentary section taken along line 16—16 of FIG. 11.
Figure 17:
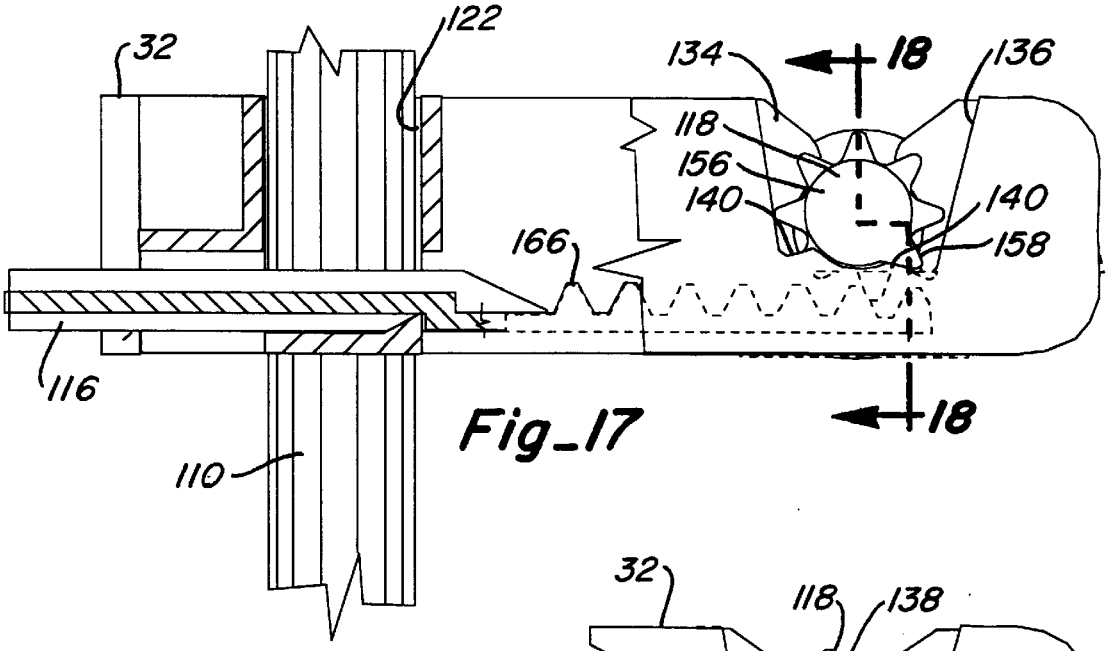
FIG. 17 is an enlarged fragmentary section taken along line 17—17 of FIG. 12.
Figure 18:
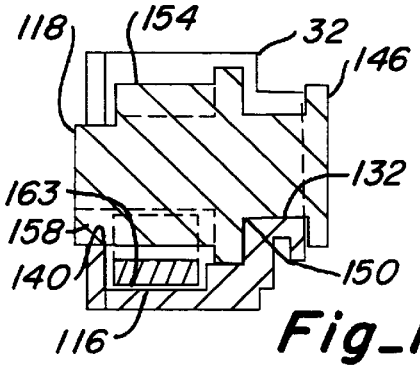
FIG. 18 is a section taken along line 18—18 of FIG. 17.
Figure 24:
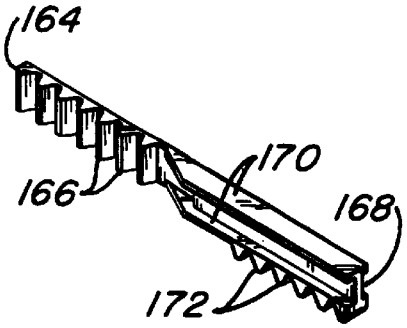
FIG. 24 is an isometric view of a rack positionable in the carrier body of FIG. 20.

The vertical axis of the hanger pin is slightly offset from a horizontal longitudinal channel 163 defined through the carrier body by a plurality of wall members. The channel is probably best seen in FIGS. 12, 17, 18, 20 and 22. The teeth on the pinion gear 154 of the hanger pin 118 protrude into the horizontal channel 163. The channel slidably receives the rack 116 which is best seen in FIGS. 16 and 17. One end 164 of the rack as best seen in FIG. 24 is plate-like and positioned adjacent to the pinion gear. The plate-like end 164 has a set of teeth 166 on a side wall thereof which mesh with the teeth on the pinion gear 154. The opposite end 168 of the rack is of generally I-shaped cross-section having reinforcing upper and lower beam sections 170 for rigidification and a second set of teeth 172 formed along the lower surface thereof.

Figure 11:
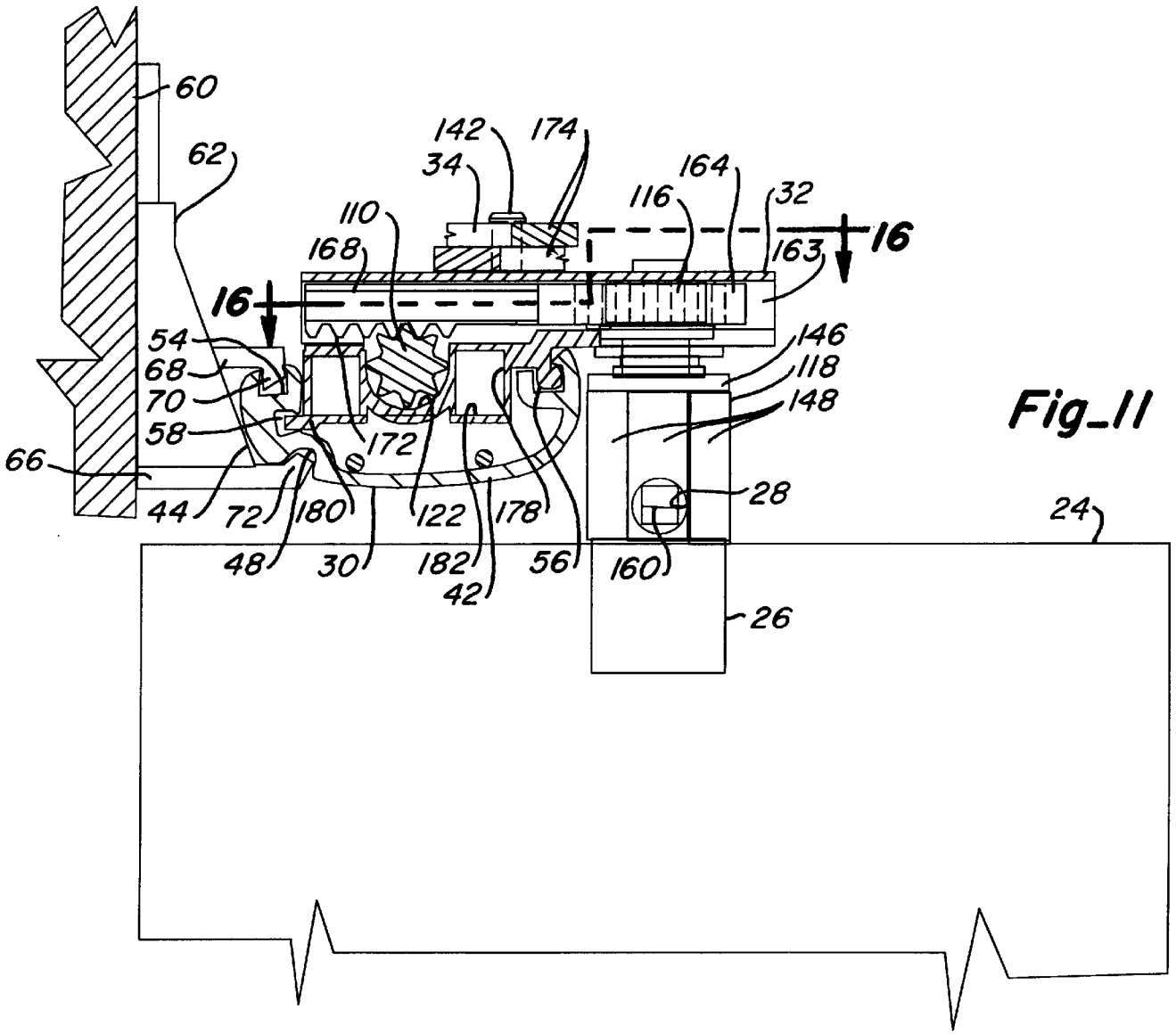
FIG. 11 is an enlarged fragmentary section taken along line 11—11 of FIG. 3.
Figure 12:
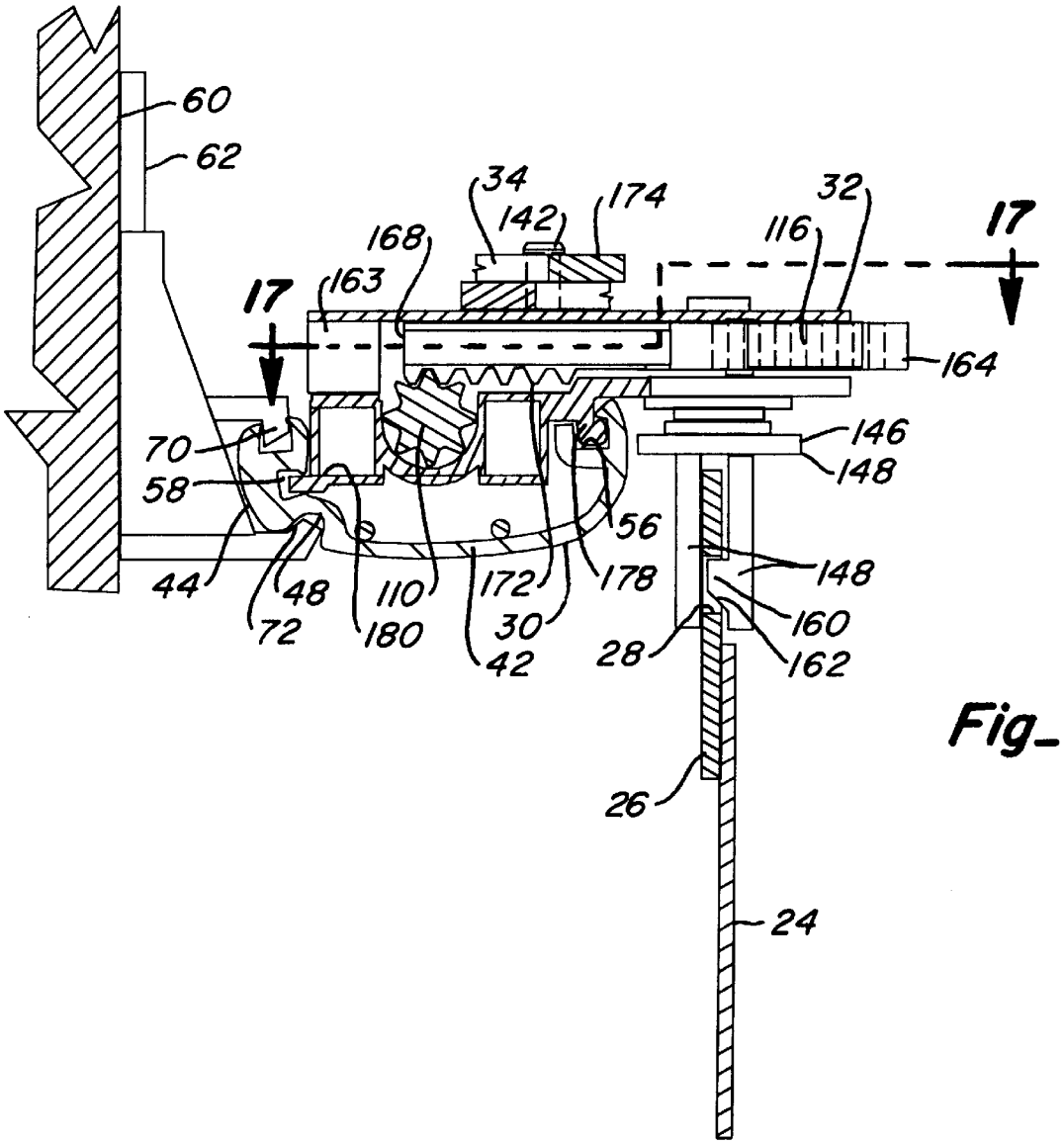
FIG. 12 is an enlarged fragmentary section taken along line 12—12 of FIG. 4.

The channel 163 through the carrier body 114 that receives the rack 116 also communicates with the substantially cylindrical passage 122 in the carrier body that receives the tilt rod 110 (FIGS. 11 and 12). In fact, the second set of teeth 172 on the rack protrude into the cylindrical passage 122 and mesh with the teeth on the tilt rod. It will therefore be appreciated that rotation of the tilt rod causes the rack 116 to be translated or moved linearly and longitudinally of the carrier body and as a consequence, the first set of teeth 166 on the rack which are engaged with the pinion gear 154 on the hanger pin 118 pivot the hanger pin in a direction dependent upon the direction of linear movement of the rack.

Figure 8:
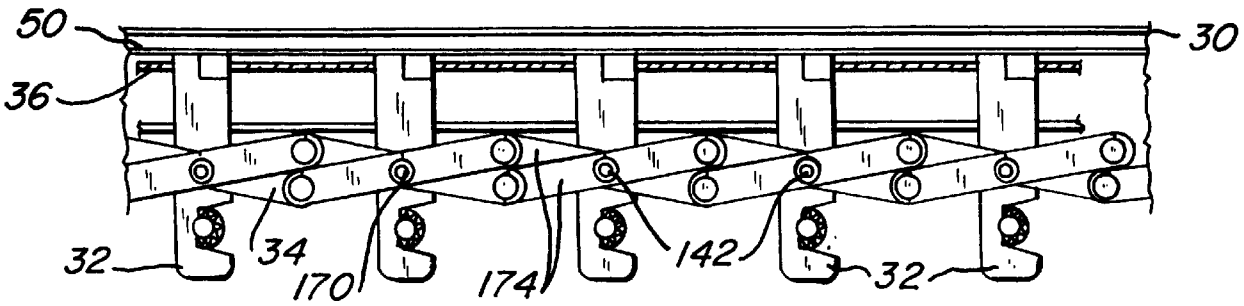
FIG. 8 is a fragmentary top plan of the control system of the present invention with the linkage fully extended.
Figure 9:
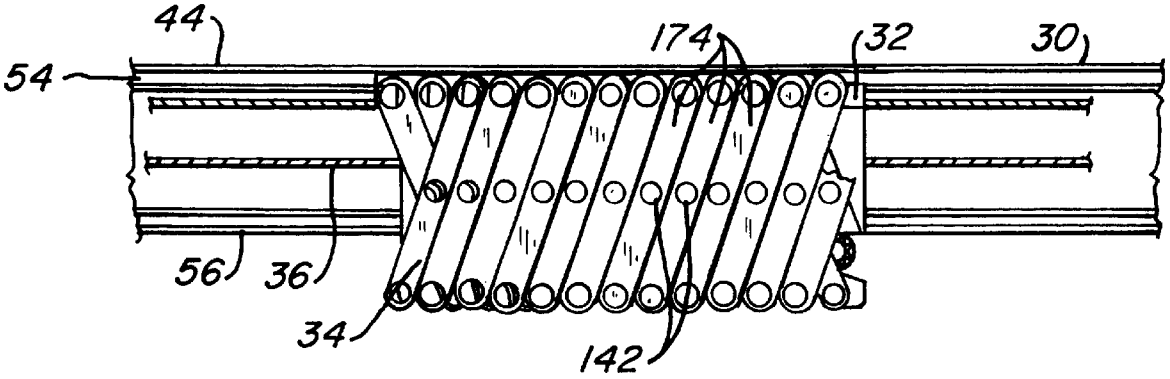
FIG. 9 is a fragmentary top plan similar to FIG. 8 with the linkage fully retracted.
Figure 10:
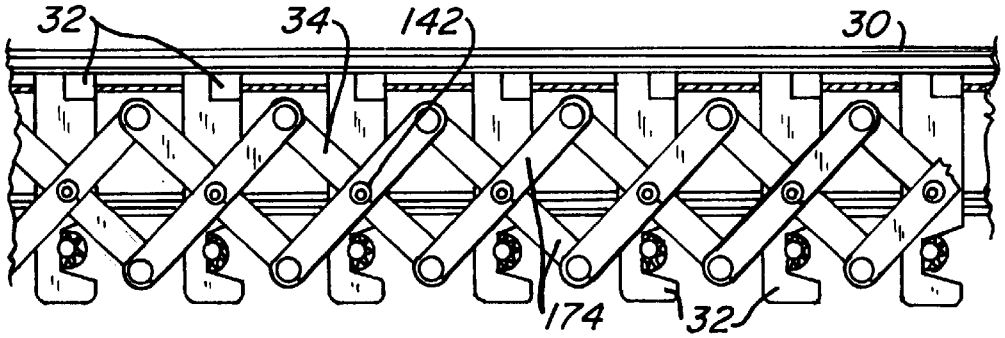
FIG. 10 is a fragmentary top plan similar to FIG. 8 with the linkage in an intermediate position.

The carriers 32 are interconnected to each other and connected to the primary end cap 74 by the linkage 34 in the form of a pantograph otherwise known as scissors-type linkage. As best appreciated by reference to FIGS. 7–10, the linkage includes a plurality of interconnected links 174 wherein two associated links form a pair and are pivotally interconnected at a mid-point. The ends of each link 174 in a pair are pivotally connected to associated ends of links in an adjacent pair. The scissors-type linkage is, therefore, adapted to be extended to a maximum length (FIG. 8) which is predetermined by the number of interconnected link pairs or retracted into a compact position as seen in FIG. 9 wherein corresponding links on adjacent pairs of links are positioned contiguous with each other.

Figure 5:
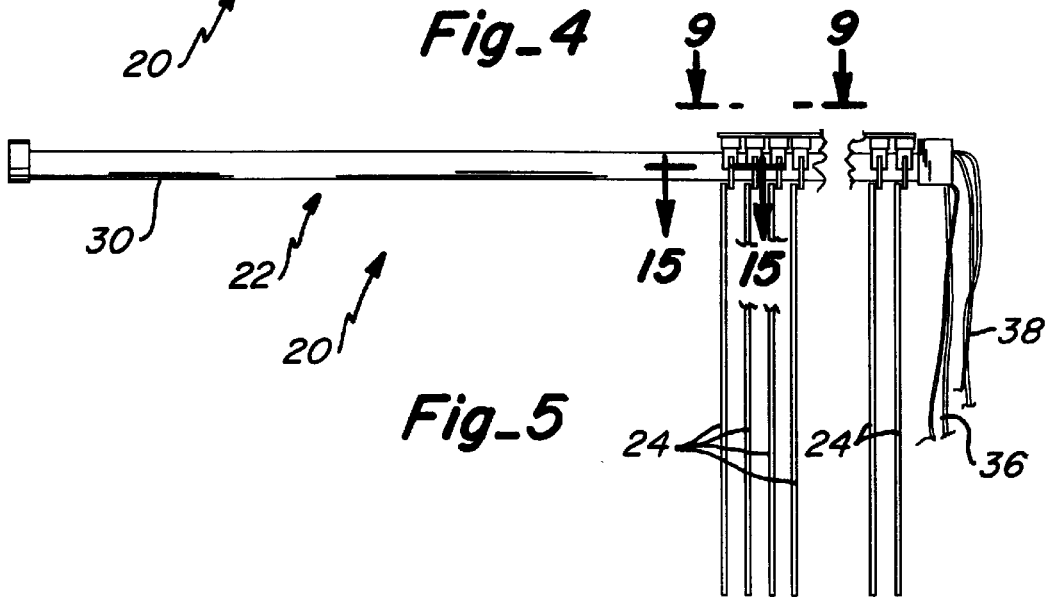
FIG. 5 is a front elevation similar to FIG. 3 with the vanes in a retracted and open position.

The scissors-type linkage 34 is interconnected with the carriers 32 through the upstanding pin 142 on the top wall 120 of the carriers. The pin 142 is made of a somewhat resilient material, for example Celcon®, and is forced through an opening 176 in the pivoted joint intermediate the ends of two links 174 in a pair. Each pair of links is thereby associated with an individual carrier and pivotally confined between the head 144 on the pin and the top wall of the carrier body. It will, therefore, be appreciated that extension or retraction of the scissors-type linkage causes the connected carriers to move accordingly so that the carriers are likewise moved between a fully extended equally spaced position as shown in FIGS. 1 and 8, and a closely adjacent retracted or horizontally stacked relationship as shown in FIGS. 5 and 9.

The carriers 32 are confined in their movement through their interrelationship with the headrail 30 as is probably best appreciated by reference to FIG. 11. Each carrier body at a location approximately at its mid-point on an undersurface thereof has a depending transversely extending bead 178 which is releasably confined within the upwardly opening groove 56 in the outermost leg 46 of the headrail. A plate-like extension 180 on the lower surface of the carrier body 114 adjacent the innermost end of the body protrudes into the inwardly opening groove 58 on the inner leg 44 of the headrail. By inserting the carrier into the ends of the headrail so that the bead 178 and the plate-like extension 180 are received within the corresponding grooves, it will be seen that the carrier cannot be laterally or vertically displaced from the headrail and will be guided in sliding movement along the headrail by the two grooves. As mentioned previously, when the carrier body is made of a low coefficient of friction material such as Celcon® and is minimally engaged with the painted aluminum headrail as described, the sliding movement is very smooth and quiet which are both desirable characteristics of a control system for a window blind. The carriers can also be seen to extend beyond the front side of the headrail so that the vanes 24 are suspended from a location offset from the longitudinal center line of the headrail.

From the above-noted description, it will be appreciated that extension and retraction of the scissors-type linkage 34 will cause the carriers 32 to slidingly move longitudinally of the headrail 30. The movement of the carriers and consequently the expansion and contraction of the scissors-type linkage is effected by the traverse cord 36 which as mentioned previously forms an endless loop through the headrail and includes a connection to the lead carrier 32A. The lead carrier may be but does not necessarily have to be the carrier furthest displaced from the primary end cap 74. The previously mentioned connection of the two ends of the traverse cord to the lead carrier is accomplished by passing the two ends of the cord in reverse directions through a square shaped channel 182 formed adjacent the bottom of the carrier on the tilt rod side and subsequently passing the ends around the carrier and tying them to themselves so that the lead carrier is integrated into the traverse cord and is forced to move in synchronism with the traverse cord. It will, therefore, be seen that movement of the traverse cord in one direction will cause the lead carrier to move in a first direction along the length of the headrail and movement of the traverse cord in the opposite direction will cause the lead carrier to move in the opposite direction along the headrail. Of course, movement of the lead carrier causes the remaining or follower carriers 32 to move accordingly so that when the lead carrier is moved as far as it can be moved toward the primary end cap (FIG. 9), it will effect a stacking of the carriers adjacent the primary end cap 74 and in adjacent relationship with each other. Movement of the lead carrier in the opposite direction will simultaneously equally separate the carriers and maintain a uniform but growing separation until the lead carrier is moved to its fullest extent (FIG. 8) at which time the suspended vanes will be equally spaced across the window opening as desired.

Figure 3:
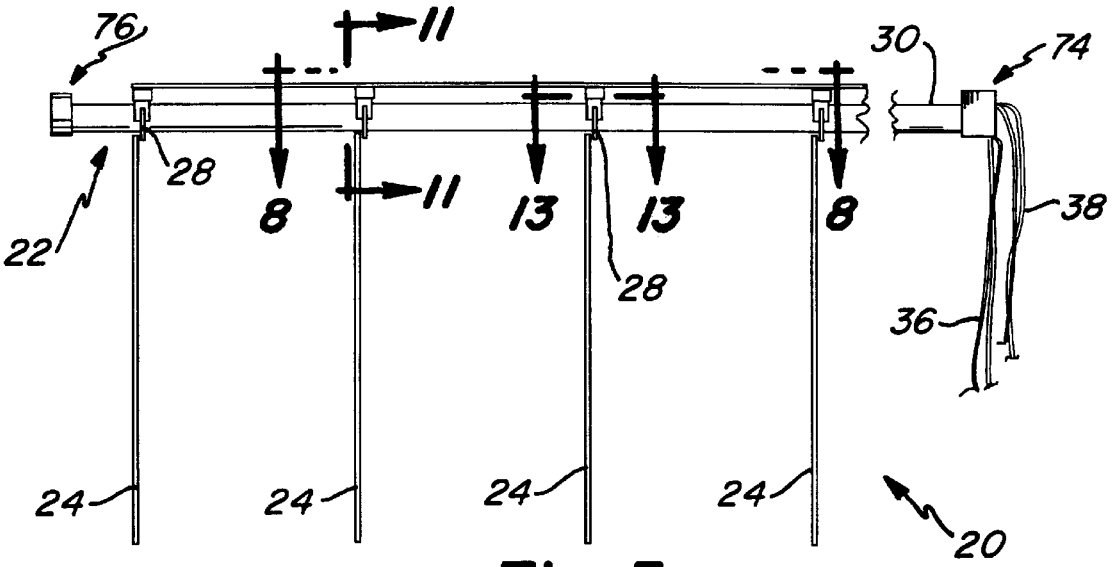
FIG. 3 is a fragmentary front elevation of the covering of FIG. 1 with the vanes extended and in an open position.
Figure 4:
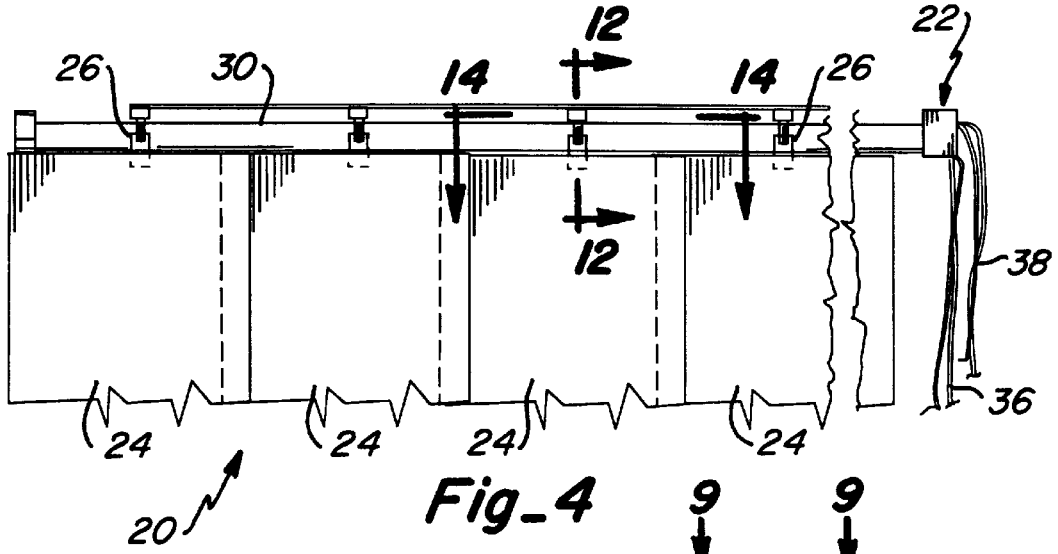
FIG. 4 is a fragmentary front elevation similar to FIG. 3 with the vanes in an expanded and closed position.
Figure 13:
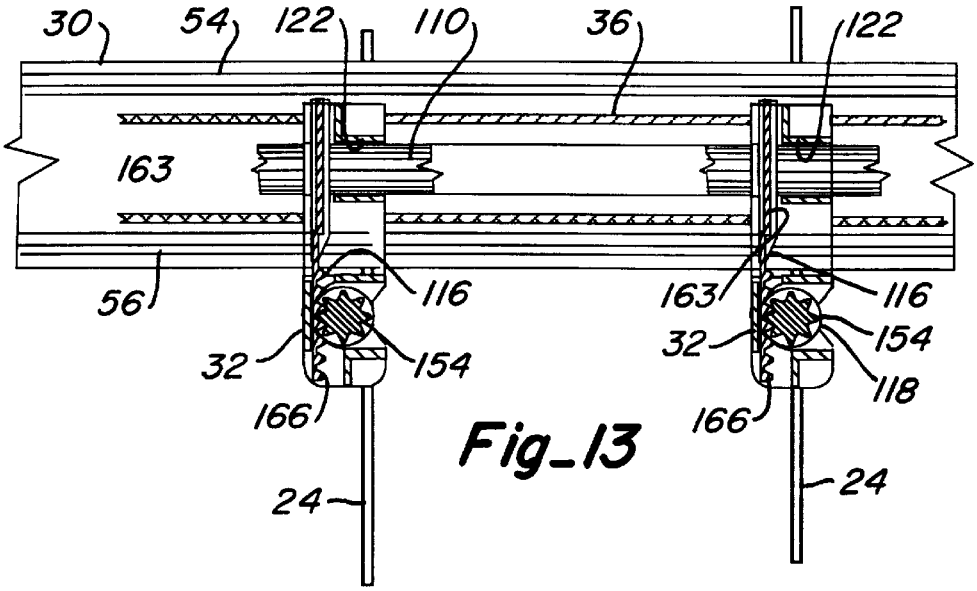
FIG. 13 is an enlarged fragmentary section taken along line 13—13 of FIG. 3.
Figure 14:
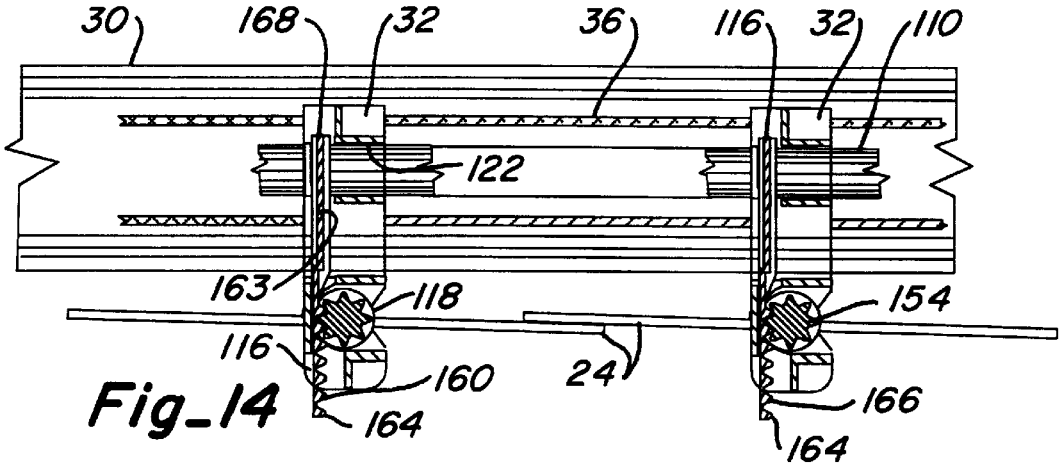
FIG. 14 is an enlarged fragmentary section taken along line 14—14 of FIG. 4.
Figure 15:
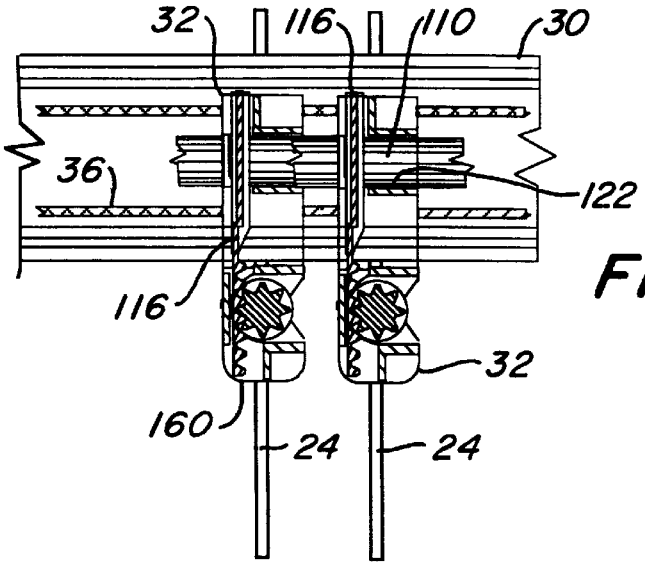
FIG. 15 is an enlarged fragmentary section taken along line 15—15 of FIG. 5.
Figure 19:
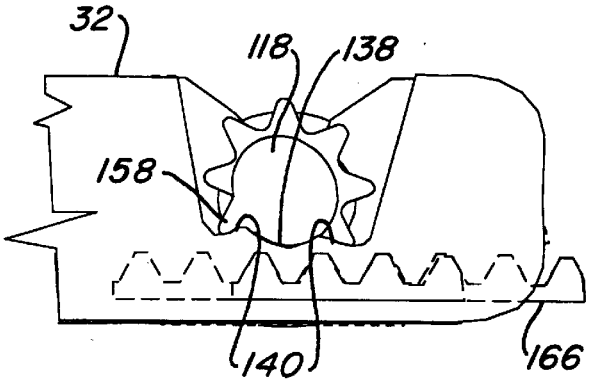
FIG. 19 is a fragmentary top plan showing a portion of FIG. 17 with the carrier pin in an approximately 180° rotated position.

Regardless of the position of the vanes 24 along the length of the headrail 30, rotation of the tilt cord 38 which affects rotation of the tilt rod will pivot the vanes through the interaction between the first set of teeth 166 on the rack 116 and the pinion gear 154 on the hanger pins. As mentioned previously, however, this motion is limited either by the vanes abutting themselves or by the abutment finger 158 on the top of each hanger pin which when rotated in one direction ultimately abuts one of the stops 140 (FIG. 17) and when rotated in the opposite direction abuts the other stop 140 (FIG. 19). As will be appreciated, and as mentioned previously, this pivotal movement is slightly greater than 180° so that the vanes suspended from the hanger pins are movable through an angle of slightly greater than 180°. The extreme positions of the hanger pins are predetermined relative to the rack so that the vanes are in a closed substantially co-planar overlapping relationship with each other in either extreme position. Movement of the hanger pins through approximately 90° (FIG. 16) from either extreme moves the vanes into their open position as seen in FIGS. 1, 3 and 13 and continued rotation through another 90° causes the abutment finger to engage the opposite stop and again place the vanes in a coplanar overlapping relationship but in a reverse direction.

It should be appreciated from the aforenoted description that the control system is very low in profile with the headrail itself having a dimension no greater than 0.6 inches and the extension of the carrier above the headrail being no more than 0.6 inches. Accordingly, the overall height of the control system is no more than 1.2 inches. In addition, there are no visible slots or openings in the headrail as the only opening faces upwardly and is therefore not visible from the interior of the room in which the system is mounted. Accordingly, a control system has been described which is aesthetically attractive and which provides dependable, smooth and quiet operation.

Figure 26:
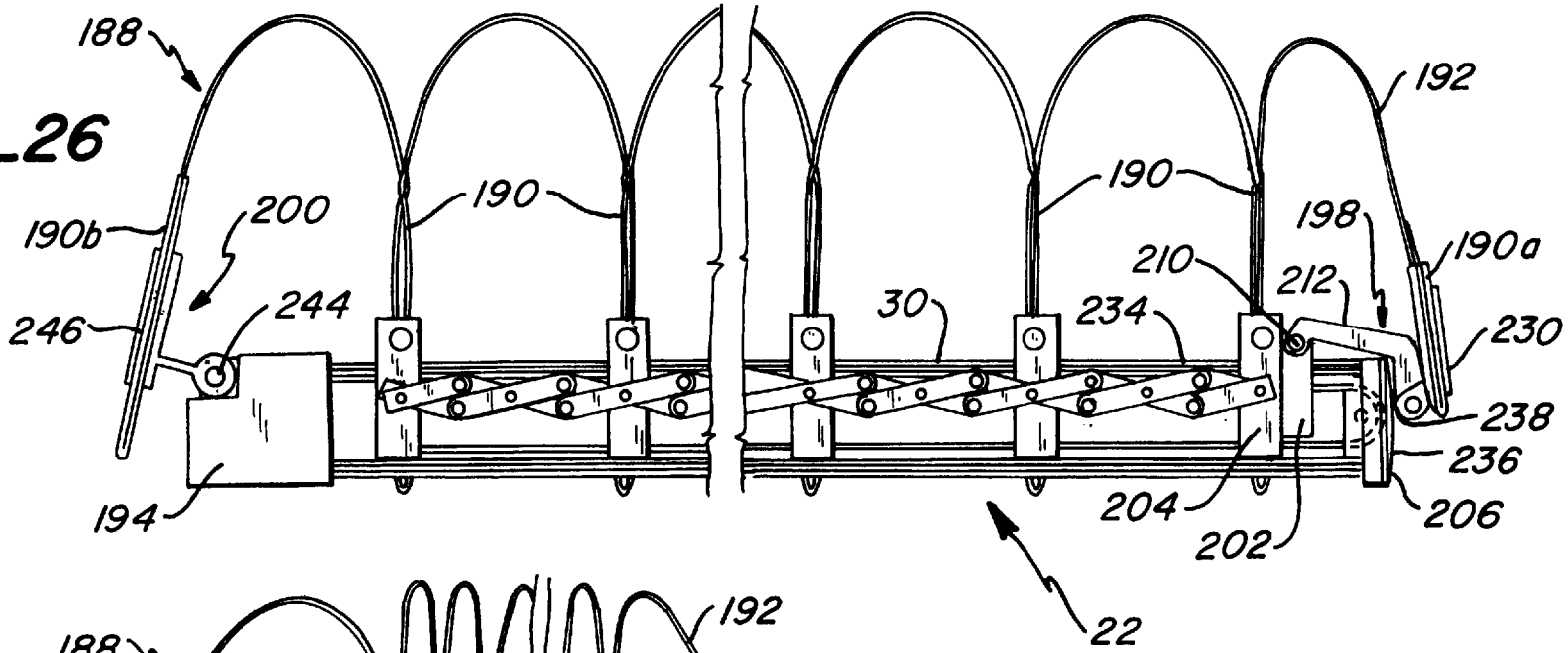
FIG. 26 is a top plan view with portions broken away of the control system of the present invention with hardware for controlling the endmost vanes of an architectural covering with the covering in an extended and open position.
Figure 27:
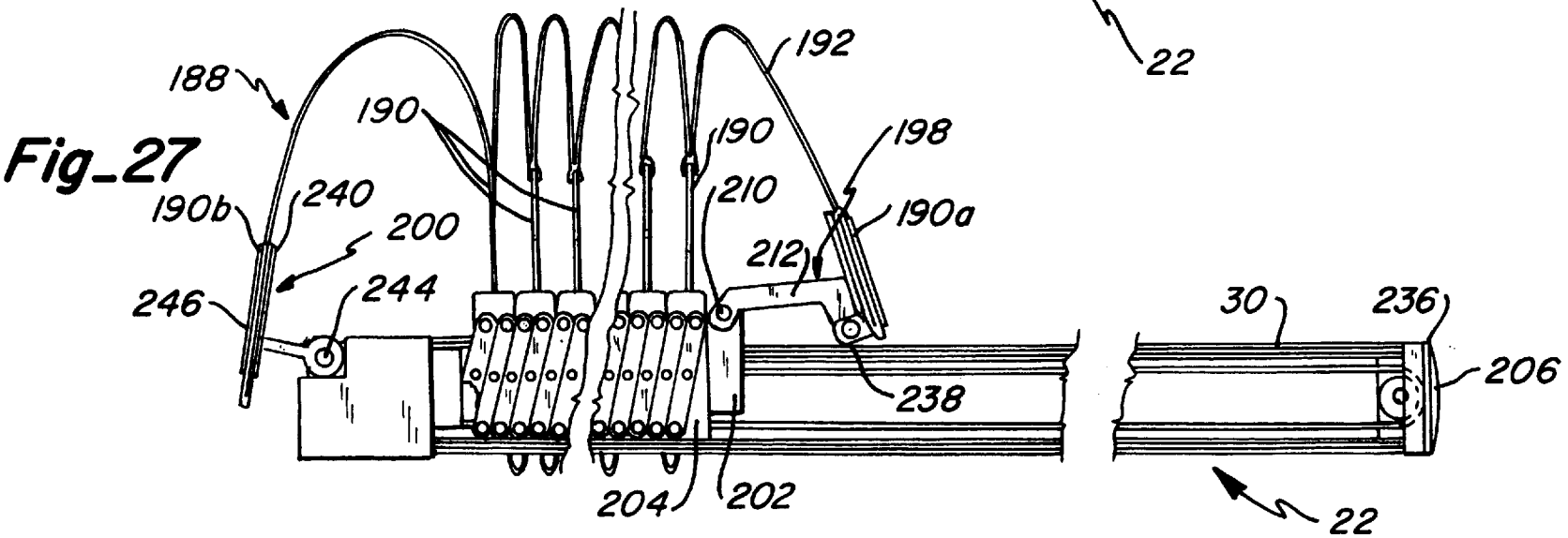
FIG. 27 is a top plan view similar to FIG. 26 with the vanes in a retracted but open position.
Figure 28:
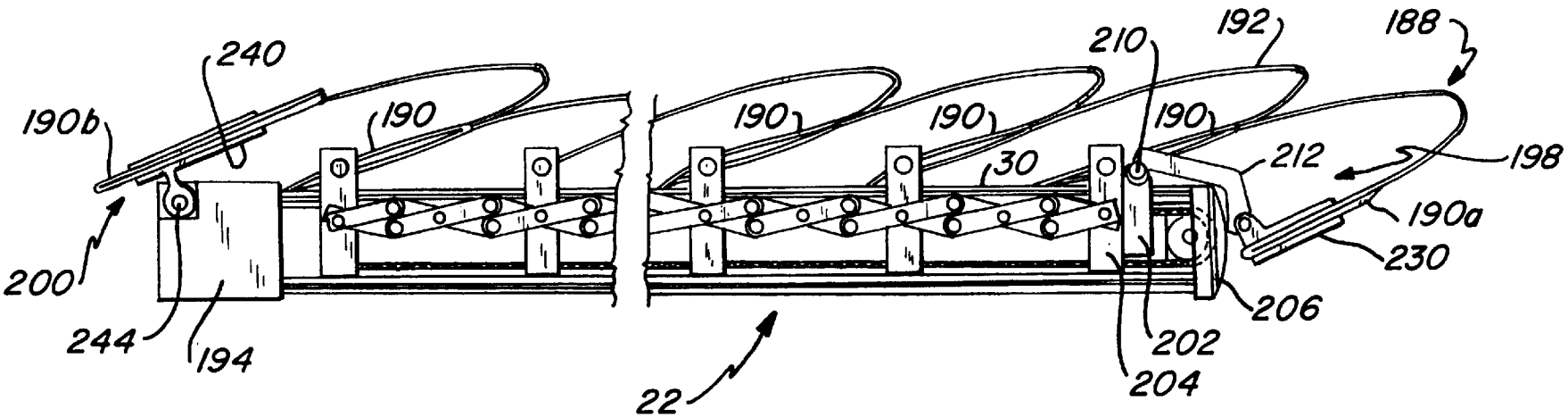
FIG. 28 is a top plan view similar to FIG. 26 with the vanes in an extended but closed position.

FIGS. 26–34 illustrate a control system of the present invention with the addition of auxiliary control elements operatively connected to the endmost vanes in the illustrated window covering 188 and also including a tilt wand 189 in place of the previously described tilt cord 38. Further, the window covering 188 is modified relative to that described previously in that the vanes 190 are connected to a continuous face sheet of material 192 such as in accordance with the disclosure in U.S. patent application Ser. No. 08/639,889, filed concurrently herewith and entitled An Improved Fabric For An Architectural Covering And Method And Apparatus of Manufacturing Same. That application is commonly owned with the present application and is incorporated herein by reference. It will be appreciated that in accordance with the disclosure in the aforenoted copending application and as shown in FIG. 28, there are vanes 190*a* and 190*b* provided at each end of the window covering. These vanes could be full width vanes, equivalent in width to the other vanes used in the covering, or might be narrower if desired. It should also be appreciated that window coverings can be single draw or center draw. Single draw coverings utilize one continuous covering that covers an architectural opening with a free end vane that is moved from one side of the opening to the opposite side. A center draw system has a pair of coverings wherein the free end vanes move toward each other when extending the covering so that they meet at a centered location of the opening and move in opposite directions toward opposite ends of the control system when retracting the covering.

It will be appreciated with the description that follows that the mounting of a fixed end vane 190*b* on the primary end cap 194, where a traverse cord 191 and the tilt wand 189 for the system are located, would be the same regardless of whether the system is a single draw or center draw. The mounting for the free end vane 190*a*, however, on the moving end of the covering to be described hereafter, is used only in a single draw system.

With specific reference to FIGS. 26–28, it will be appreciated that many of the primary operative components of the modified control system are identical to that previously described in connection with the control system 22 with the exception of the primary end cap wherein the control system has been modified to utilize the tilt wand 189 in place of the tilt cord 38. Before describing the systems for mounting the endmost vanes, the modified primary end cap 194 will be described.

Figure 35:
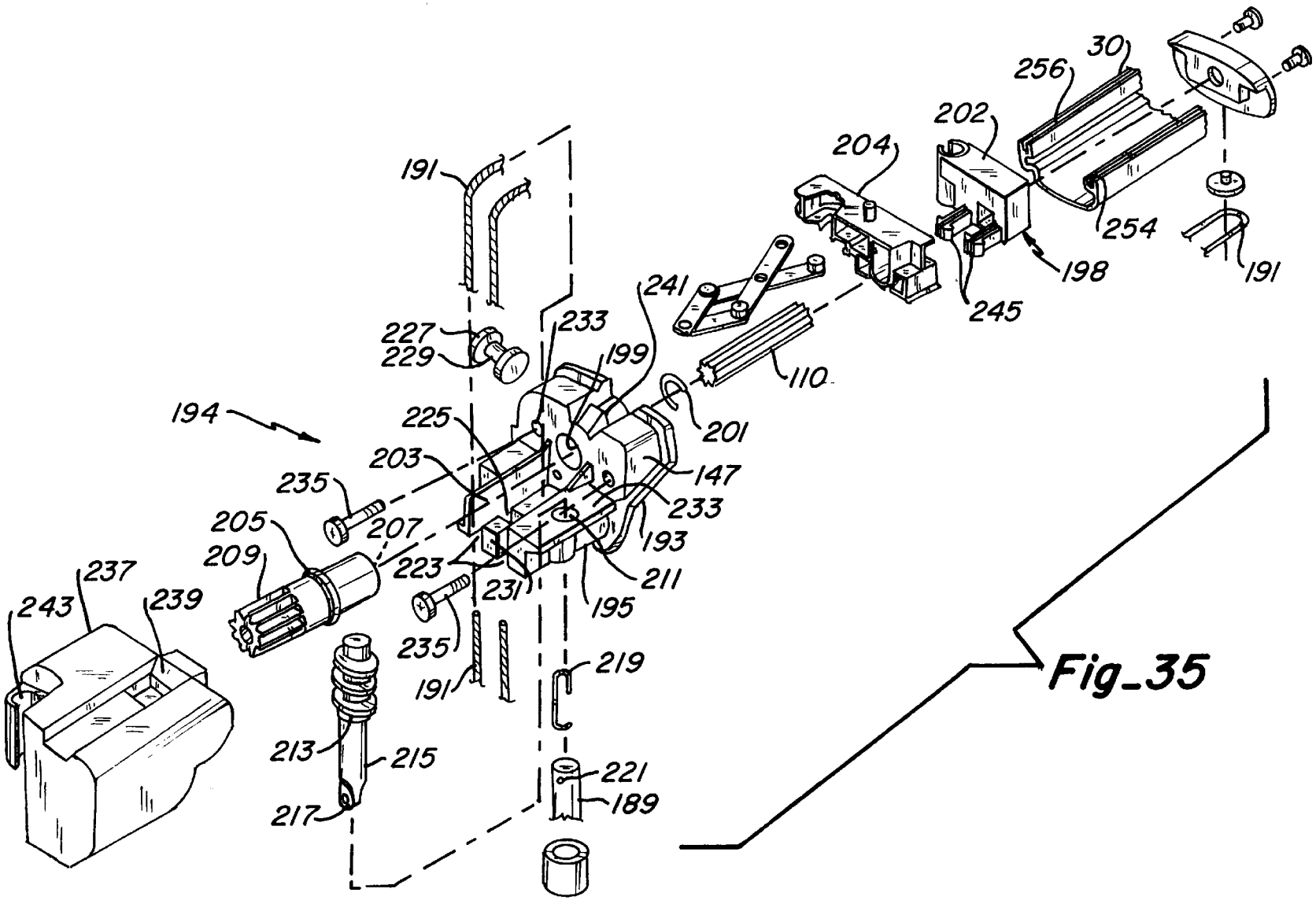
FIG. 35 is an exploded isometric of an alternative control system having a different primary end cap.
Figure 36:
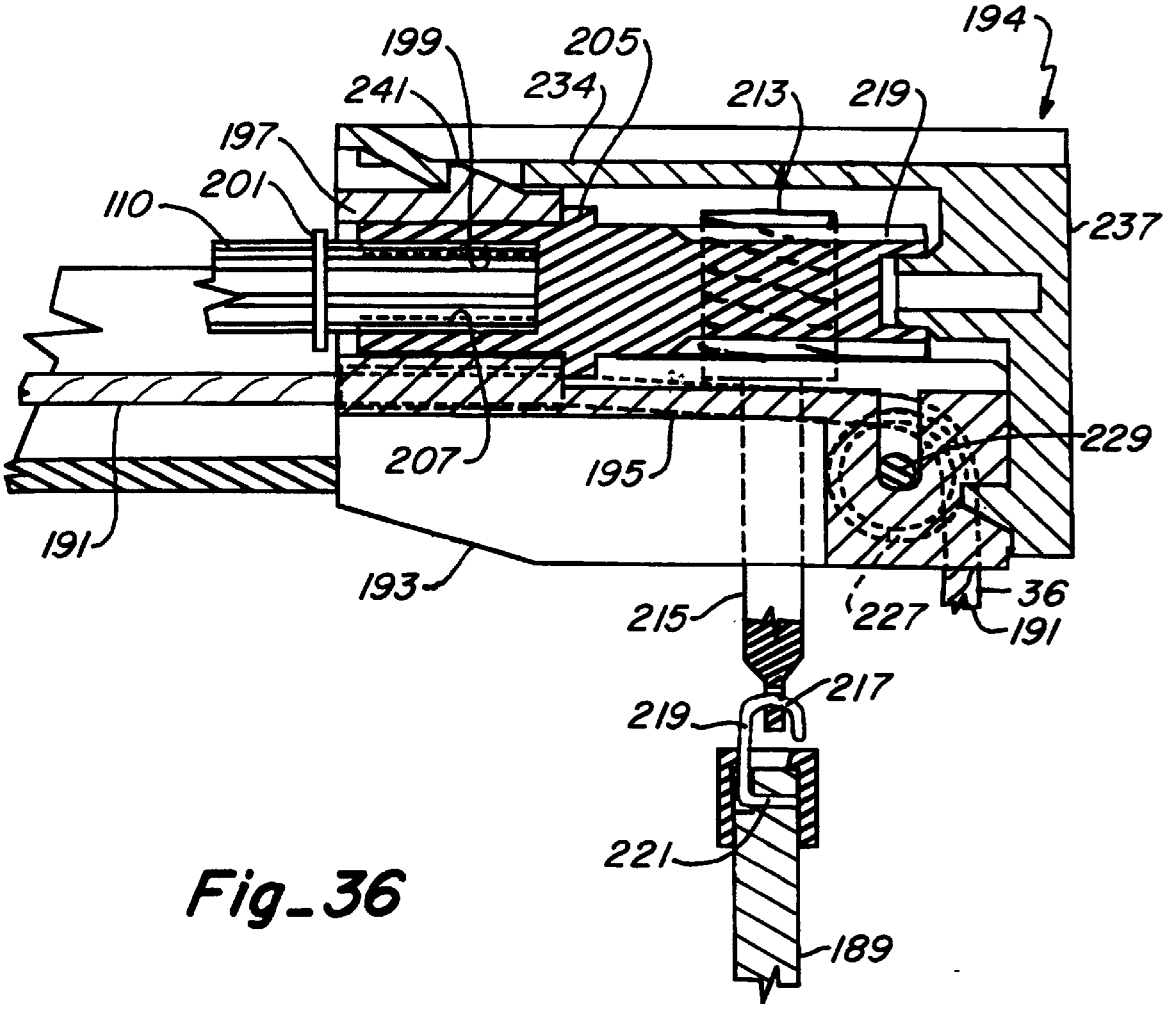
FIG. 36 is an enlarged fragmentary vertical section taken through the primary end cap shown in FIG. 35.

As probably best seen in FIGS. 35 and 36, the primary end cap 194 can be seen to include a main body 193 having a horizontally extending base portion 195 and a vertically extending end plate 197. The end plate has a horizontal passage 199 of cylindrical configuration extending therethrough adapted to rotatably receive and support the end of the tilt rod 110. A C-clip 201 is used in a conventional manner to retain the tilt rod in the cylindrical passage 199. The base portion 195 of the main body 193 has an upwardly opening horizontal channel 203 defined in alignment with the passage 199 in the end plate that is adapted to rotatably receive and seat a drive collar 205 having a socket 207 in one end with internal teeth. The socket 207 is adapted to receive the associated end of the tilt rod 110 such that the longitudinal teeth on the tilt rod mesh with the internal teeth in the socket. The opposite end of the drive collar 205 defines a pinion gear 209. Immediately adjacent to the channel 203, a vertical passage 211 is provided through the base portion 195 that is adapted to receive a worm gear 213 such that the worm gear operatively engages the pinion gear 209 to transfer rotative motion about the vertical axis of the worm gear to vertical rotative motion of the pinion gear about a horizontal axis. The worm gear is supported in the base portion 195 for rotative movement while retaining alignment of the worm gear with the pinion gear. The worm gear has a depending shaft 215 with a transverse connection opening 217 therethrough that is adapted to receive a C-shaped connector pin 219. The opposite end of the connector pin is received in a transverse passage 221 in the upper end of the conventional tilt wand 189 so that rotation of the tilt wand affects rotation of the worm gear 213 and consequently the pinion gear 209 and the tilt rod 110 through their operative connections.

The base portion 195 of the main body 193 further defines a pair of vertical slots 223 in a rear surface thereof and a transverse channel 225 interconnecting the slots for receipt of a pair of pulleys 227 mounted on opposite ends of a support shaft 229. The support shaft is rotatably seated in the transverse channel 225 with the pulleys disposed in the respective slots 223. A traverse cord 36 of the type previously described in connection with the control system 22 passes over the pulleys 227 and through cord passages 231 provided in the end plate 197. From these passages the traverse cord connects to the operative components of the head rail as previously described in connection with the control system 22.

The end plate 197 also has a pair of fastener openings 233 adapted to slidably receive bolt type fasteners 235 which extend through the openings 233 and are threaded into the ends of the upwardly opening grooves 54 and 56 of the headrail 30. In this manner, the main body of the primary end cap is positively secured to the headrail.

A shell 237 having an internal cavity conformed to receive the various components of the main body 193 is adapted to be snapped onto the main body for releasable connection thereto. A snap arm 239 on the shell releasably grabs a catch 241 on the main body to retain the shell in position to thereby cover the working components of the primary end cap.

The primary end cap also has a vertical channel 243 for mounting the fixed end vane **190*b*** as will be described in more detail later.

The free end vane **190*a* is connected to the control system with a free end vane mounting system 198. The opposite end vane or the fixed end vane 190*b* is mounted on the primary end cap 194 with a fixed vane mounting system 200. FIG. 26 shows the window covering with the end vane mounting systems when the covering is both extended and open while FIG. 27 shows the same window covering in a retracted but open position. FIG. 28** is similar but shows the covering in an extended and closed position.

Looking first at the free end mounting system 198 as best seen in FIGS. 29–32 and 35, it will be appreciated that a mounting block 202 has been secured to the endmost carrier 204 of the control system 22. The endmost carrier and mounting block are shown disposed adjacent to the secondary end cap 206 of the headrail which, as will be appreciated with the description that follows, cooperates with the free end vane mounting system to move the free end vane **190*a* from a position in front of the headrail 30, like the remaining vanes 190** in the covering, to a position at the secondary end of the headrail and in longitudinal alignment therewith when the window covering is fully extended.

The mounting block 202 is connected to the endmost carrier 204 by two pairs of snap fingers 245 on the mounting block that are releasably received in associated channels 247 formed in the endmost carrier 204. The mounting block 202 has a vertical substantially C-shaped channel 208 formed in the front edge thereof defining a bearing which receives a hollow pivot shaft 210 on the end of a pivot arm 212. The C-shaped configuration of the channel retains the pivot shaft of the pivot arm for pivotal movement within the channel. The pivot arm is substantially J-shaped in cross section having a base leg 214, an end leg 216 and an upstanding lip 218 which defines the pivot shaft. The end leg 216 has a pair of vertically extending pivot pins 220 that project upwardly and downwardly from the top and bottom edges thereof with the pivot pins pivotally receiving corresponding sleeves 222 on the back face of a vane mounting plate 224.

Figure 29:
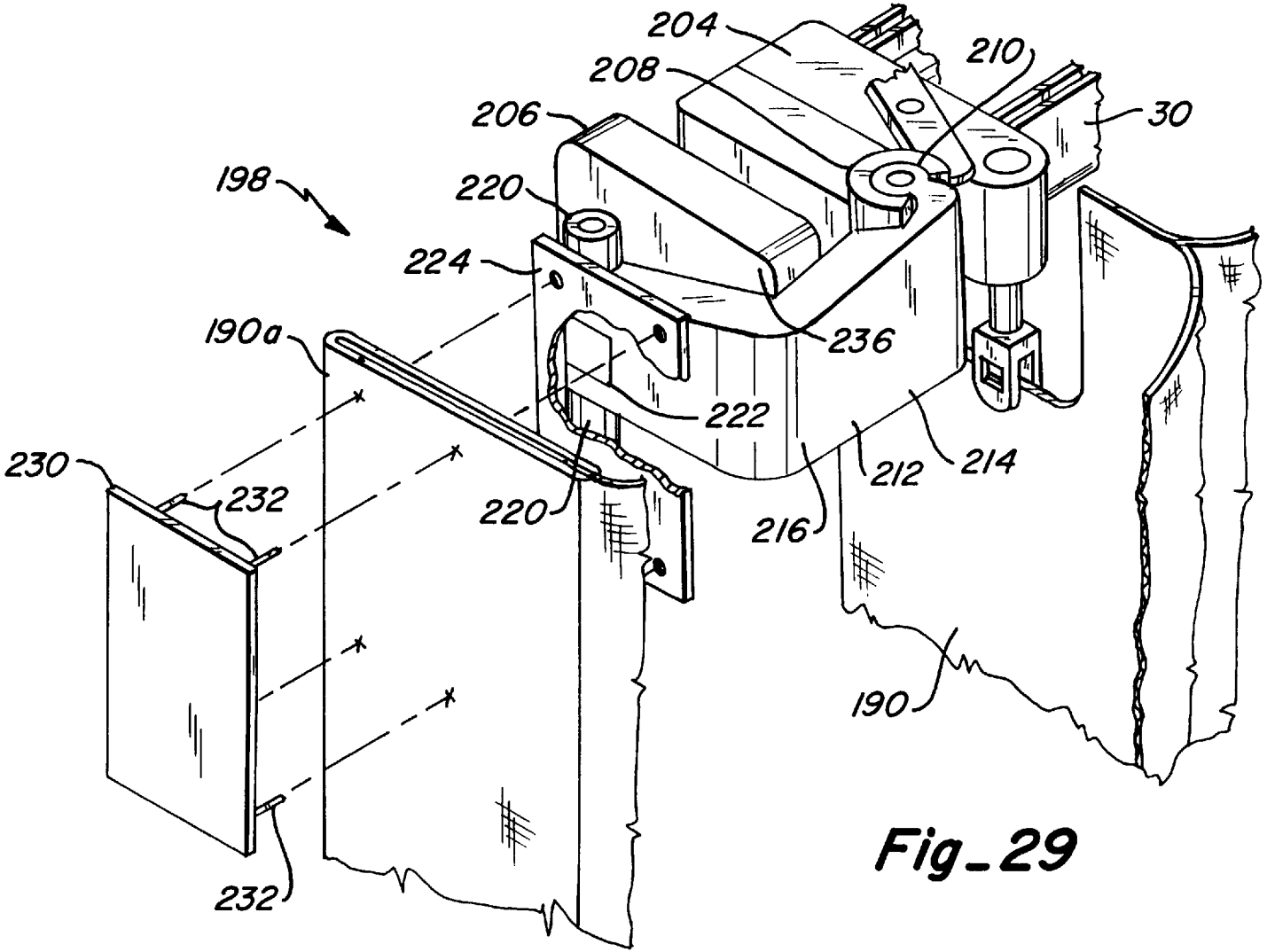
FIG. 29 is an enlarged fragmentary partially exploded isometric showing the end vane hardware for the free end of a single draw covering.
Figure 30:
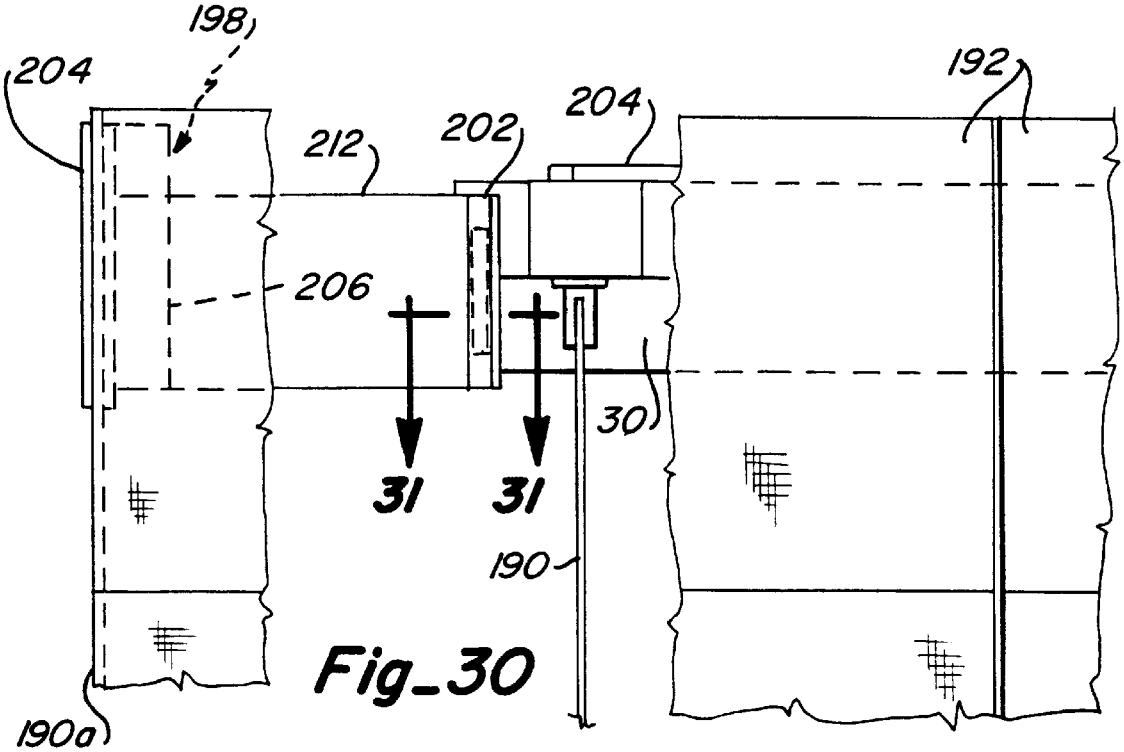
FIG. 30 is a fragmentary front elevation with portions removed of the hardware shown in FIG. 29.
Figure 31:
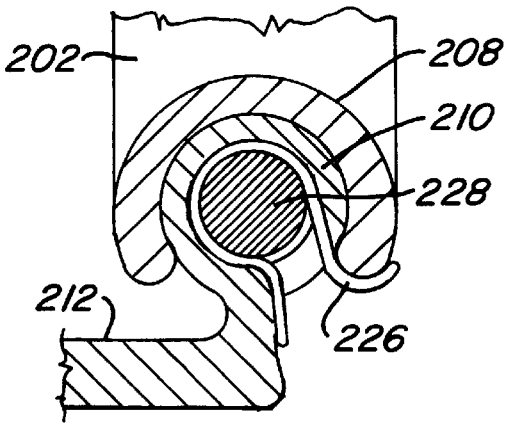
FIG. 31 is an enlarged section taken along line 31—31 of FIG. 30.
Figure 32:
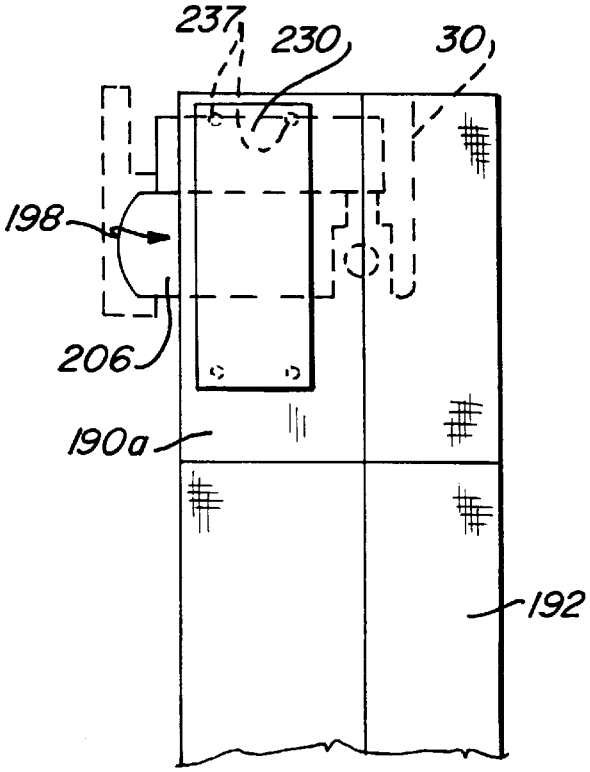
FIG. 32 is a left end elevation of the system as shown in FIG. 30.
Figure 33:
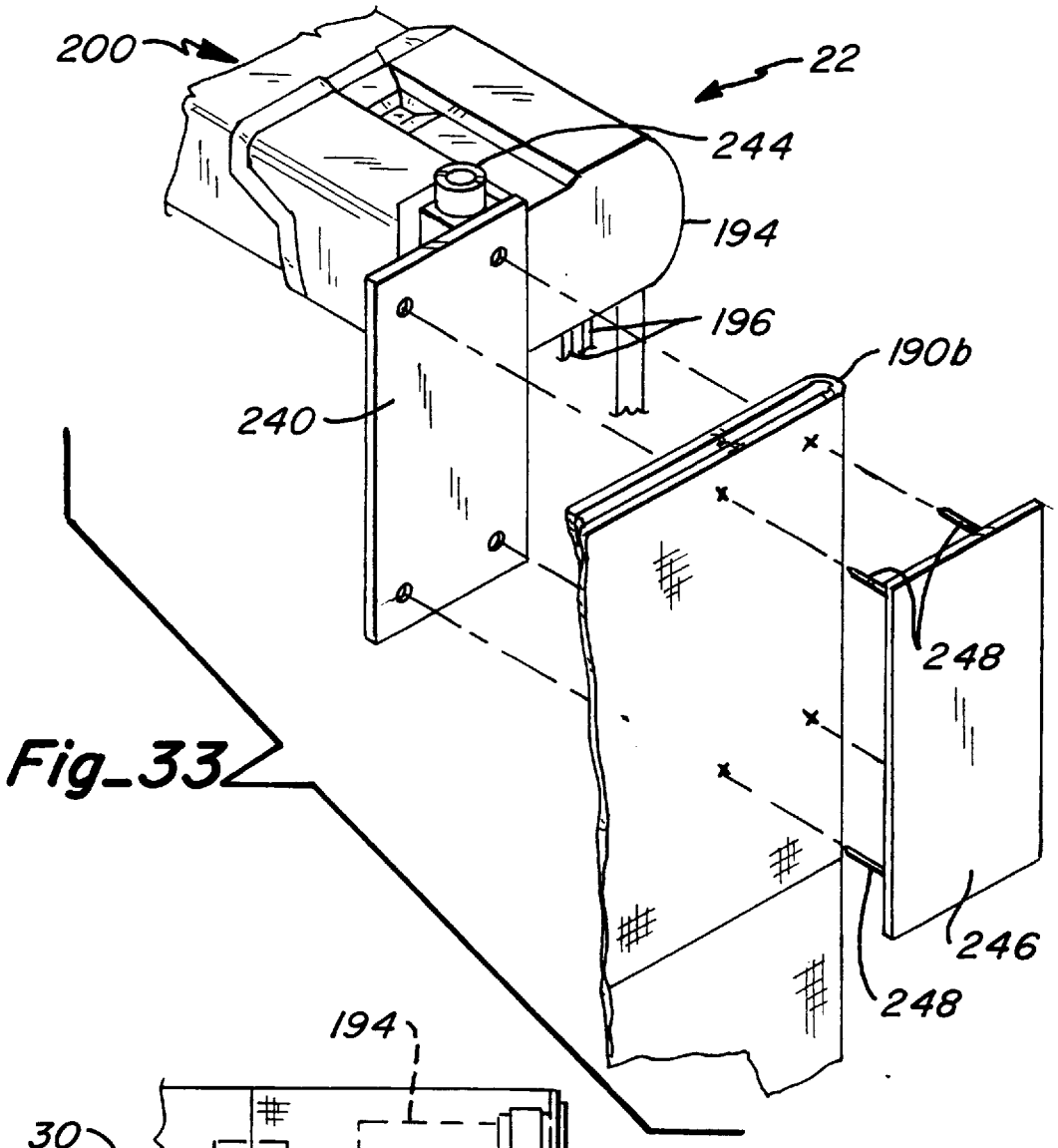
FIG. 33 is an enlarged fragmentary partially exploded isometric showing the control end of the control system showing the system for mounting the endmost vane.
Figure 34:
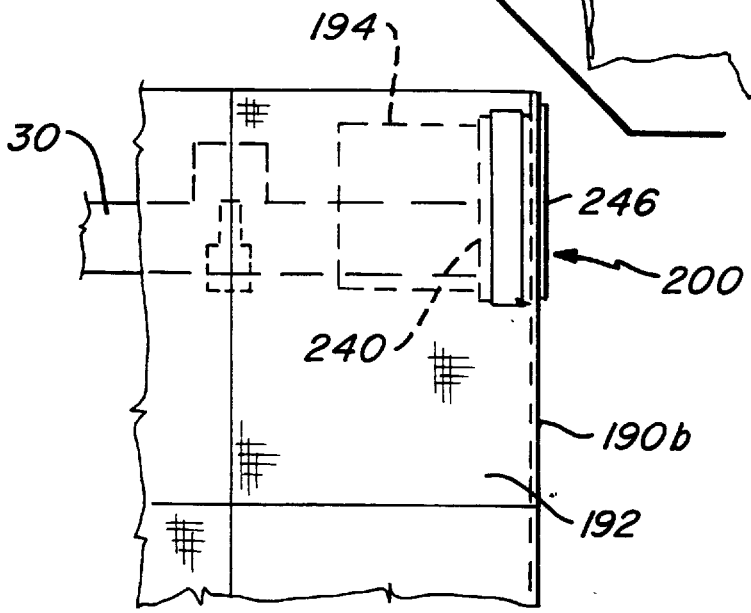
FIG. 34 is a fragmentary front elevation of the control system as shown in FIG. 33.

The pivot arm 212 is biased in a clockwise direction, as viewed in FIGS. 29 and 31, by a torsion spring 226 that partially circumscribes a pivot pin 228 within the hollow pivot shaft 210 of the pivot arm. One end of the torsion spring engages the mounting block 202 and the opposite end engages the pivot arm 212.

The vane mounting plate 224 cooperates with an attachment plate 230 to secure the free end vane **190*a* therebetween. The attachment plate has a plurality of connectors in the form of sharpened prongs 232** that are adapted to penetrate the vane and subsequently be riveted or otherwise secured to the vane mounting plate to secure the vane between the plates.

In operation, as probably best illustrated by reference to FIGS. 26 and 27, when the covering 188 is retracted adjacent to the primary end cap 194, the end leg 216 of the pivot arm 212 is biased against the front 234 of the headrail 30 by the torsion spring 226 thereby holding the free end vane **190*a* adjacent the front of the headrail. When the covering is being extended, the free end vane is moved toward a secondary end cap 236 at the opposite end of the headrail. The end leg of the pivot arm 212 has a guide surface 238 on the terminal end thereof which slides along the front of the headrail until it reaches the secondary end cap at which time the end leg of the pivot arm is urged around the secondary end cap by the torsion spring into the position illustrated in FIG. 26. It will be appreciated in the extended position of the covering 188, that the free end vane 190*a*** is pulled around the end of the headrail in longitudinal alignment therewith to help conceal the headrail and provide an aesthetically attractive end of the covering, which also establishes privacy.

When the covering 188 is moved toward its retracted position from its extended position of FIG. 26, the guide surface 238 on the end leg 216 of the pivot arm 212 is cammed by and rides along the secondary end cap 236 against the bias of the torsion spring 226 until the guide surface engages and is pulled onto the front 234 of the headrail so that the covering can be moved to the retracted position of FIG. 27.

The control end of the control system, at the primary end cap 194 as best illustrated in FIGS. 26–28, and 33–36, has a fixed vane mounting plate 240 with a pair of vertically spaced sleeves 242 pivotally mounted on the upper and lower ends of a pivot shaft 244 received in the vertical channel 243 defined in the shell 237 of the primary end cap. The pivot shaft 244 thereby pivotally supports the mounting plate for movement about a vertical axis. An attachment plate 246, having connectors in the form of sharpened prongs 248 adapted to pierce the fixed end vane 190*b*, is operatively connected to the mounting plate as by riveting, sonically welding or otherwise so as to positively secure the fixed end vane between the plates 240 and 246.

The fixed vane mounting plate 240 is freely pivotal on the pivot shaft 244 so as to be movable under the influence of the face sheet material 192 which is connected to the fixed end vane 190*b*.

With specific reference to FIGS. 26 and 28, it will be appreciated in FIG. 26 that when the vanes 190 are in an open position, i.e. perpendicular to the headrail 30, the face sheet material 192 that is connected to the vanes is looped in a direction also perpendicular to the headrail thereby forcing the fixed end vane 190*b* to pivot about its pivotal connection to the primary end cap 194 into a position where it overlies the end of the primary end cap in longitudinal alignment with the headrail and extends substantially perpendicularly to the headrail. However, when the vanes are moved from their open to the closed position illustrated in FIG. 28, the face sheet material 192 pulls the fixed end vane forcing it to pivot about its pivotal connection so that the vane lies somewhat parallel to the front of the headrail in parallel alignment with the other vanes in the covering.

It will therefore be appreciated from the above description that by providing mounting systems as described for the endmost vanes in the covering that the ends of the headrail can be covered when desired and the endmost vanes are also pivotally mounted for movement with the remainder of the vanes in the covering. The system thereby provides an aesthetically attractive way of connecting the endmost vanes to the operating system in a relatively inexpensive but efficient manner while also establishing privacy at the ends of the covering.

Although the present invention has been described with a certain degree of particularity, it is understood that the present disclosure has been made by way of example, and changes in detail or structure may be made without departing from the spirit of the invention as defined in the appended claims.

The invention claimed is:

1. A control system for operating a vertical blind wherein said vertical blind includes a plurality of vertically suspended vanes including a free end vane, said control system comprising in combination, an elongated headrail having a primary end cap and a secondary end cap, a plurality of carriers operatively associated with said vanes, said carriers being movably mounted on said headrail for movement along said headrail between an extended position and a retracted position, control means at said primary end cap for selectively moving said carriers between said extended and retracted positions, said carriers adapted to operatively support said free end vane to selectively position said free end vane at said secondary end cap when said carriers are in said extended position and a mounting block movable with said carriers adapted to operatively support said free end vane, said mounting block including a pivot arm adapted to extend around said secondary end cap to position said free end vane in longitudinal alignment with said headrail when the carriers are in said extended position.

2. The control system of claim 1 wherein said pivot arm and free end vane are positioned laterally adjacent said headrail when said carriers are in the retracted position.

3. The control system of claim 2 further including biasing means operatively associated with said pivot arm for biasing the arm toward the position it assumes when the carriers are fully extended.

4. The control system of claim 3 wherein said pivot arm has a guide surface, said guide surface being biased against said headrail in sliding engagement therewith.

5. The control system of claim 4 wherein said secondary end cap has an end surface in longitudinal alignment with the headrail and wherein said guide surface engages said end surface when the carriers are fully extended.

6. The control system of claim 5 wherein said headrail has a lateral side surface against which said guide surface is engaged when said carriers are in the retracted position and wherein said guide surface moves against the bias of said biasing means when the carriers are moved from the extended to the retracted position.

7. A control system for operating a vertical blind wherein the vertical blind has a plurality of vertically suspended vanes including a fixed end vane, said control system comprising in combination, an elongated headrail having a primary end cap and a secondary end cap, a plurality of carriers operatively associated with said vanes with the exception of said fixed end vane, and being movably mounted on said headrail for movement between an extended and a retracted position, control means at said primary end cap for selectively moving said carriers between said extended and retracted positions, a pivot adapted to pivotally mount said fixed end vane to said headrail at said primary end cap and means operatively connecting said fixed end vane to other of said vanes whereby movement of the other of said vanes effects pivotal movement of said fixed end vane.

8. The control system of claim 7 further including a face sheet of material interconnecting said vanes such that movement of said vanes associated with said carriers effects pivotal movement of said fixed end vane.

9. The control system of claim 7, further including a free end vane adapted to be positioned at said secondary end cap when said carriers are in said extended position and a mounting block movable with said carriers supporting said free end vane, said mounting block including a pivot arm adapted to extend around said secondary end cap to position said free end vane in longitudinal alignment with said headrail when the carriers are in said extended position.

10. A mounting for a free end vane in a vertical blind wherein said vertical blind has a headrail with a primary end cap and a secondary end cap, a plurality of vertically suspended vanes including a free end vane and a control system with carriers connected to the vanes for moving the vanes between an extended and retracted position of the blind, said mounting comprising a block adapted to support said free end vane and being movable with said carriers, said block including a pivot arm adapted to extend around said secondary end cap and adapted to position said free end vane in longitudinal alignment with said headrail when the carriers are in said extended position.

11. The mounting of claim 10 wherein said pivot arm and free end vane are positioned laterally adjacent said headrail when said carriers are in the retracted position.

12. The mounting of claim 11 further including biasing means operatively associated with said pivot arm for biasing the arm toward the position it assumes when the carriers are fully extended.

13. The mounting of claim 12 wherein said pivot arm has a guide surface, said guide surface being biased against said headrail in sliding engagement therewith.

14. The mounting of claim 13 wherein said secondary end cap has an end surface in longitudinal alignment with the headrail and wherein said guide surface engages said end surface when the carriers are fully extended.

15. The mounting of claim 14 wherein said headrail has a lateral side surface against which said guide surface is engaged when said carriers are in the retracted position and wherein said guide surface moves against the bias of said biasing means when the carriers are moved from the extended to the retracted position.

16. A control system for a vertical blind wherein the blind includes a plurality of vertically suspended vanes comprising in combination:

an elongated channel-shaped headrail having a pair of side walls, a bottom wall, and an open top side thereby defining a hollow interior, a plurality of carriers at least some of said carriers being interconnected to each other and mounted on said headrail so as to extend through said open top side and be selectively movable along the length of the headrail, only a minority portion of each of said carriers being disposed in the hollow interior of said headrail, said carriers each including a hanger system for suspending an associated vane and pivotally moving the vane about a vertical axis, and an operating system for selectively moving said carriers along the length of said headrail and for selectively pivoting the vanes about said vertical axis.

17. The system of claim 16 wherein said operating system includes an elongated tilt rod extending lengthwise of the headrail, said tilt rod being mounted for rotation about a longitudinal axis and having radially directed longitudinally extending teeth, said carriers having a rack and pinion system that is operatively engaged with said tilt rod such that rotation of the tilt rod about said longitudinal axis affects rotation of such vanes about said vertical axis.

18. The system of claim 17 wherein a rack is horizontally slidably disposed in each carrier and said hanger system includes a rotatably mounted hanger pin having a pinion gear operatively engaged with said rack.

19. The system of claim 18 wherein said hanger pin is removably mounted.

20. The system of claim 17 wherein said operating system further includes reciprocally movable pull cords, one pull cord being operatively connected to said tilt rod for rotating said tilt rod and another of said cords being operatively connected to at least one of said carriers for moving said carriers along said headrail.

21. The system of claim 20 wherein said carriers are interconnected by linkage which establishes a maximum spacing between adjacent carriers.

22. The system of claim 21 wherein said linkage is a scissors-type linkage.

23. The system of claim 22 further including a lead carrier and wherein said lead carrier is connected to said another of said cords for movement by said another cord such that movement of the lead carrier affects following movement of the remaining carriers.

24. The system of claim 16 wherein said carriers are slidably movable along the length of said headrail.

25. The system of claim 24 wherein said headrail is made of painted aluminum and said carriers are made of Celcon®.

26. The system of claim 16 wherein said headrail has a longitudinal centerline and said hanger systems are offset from said centerline.

27. A vertical blind control system for supporting a plurality of vertically suspended vanes comprising in combination:

a headrail having a hollow interior, a plurality of carriers at least some of which are interconnected and movable longitudinally of said headrail, each carrier adapted to suspend a vane for pivotal movement about a vertical axis of the vane, each of said carriers having an elongated rack and an operatively engaged pinion gear, said pinion gear being part of a hanger pin to which a vane is connected whereby longitudinal movement of the rack effects pivotal movement of an associated vane, said rack comprising an elongated bar having serrations along two mutually perpendicular sides defining a set of teeth in each of said sides, said sets of teeth being longitudinally offset, one set of teeth being in operative engagement with said pinion gear, and an operating system for selectively moving said carriers and for selectively pivoting said vanes about said vertical axes, said operating system including an elongated tilt rod that is rotatable about a longitudinal axis and extends longitudinally of said headrail, said tilt rod having a plurality of radially directed longitudinally extending teeth operatively engaged with the other of said set of teeth on the rack whereby rotative movement of said tilt rod effects longitudinal movement of said rack and pivotal movement of an associated vane.

28. The system of claim 27 wherein said rack is horizontally disposed.

29. The system of claim 27 wherein said operating system further includes reciprocally movable pull cords, one pull cord being operatively connected to said tilt rod for rotating said tilt rod and another of said cords being operatively connected to at least one of said carriers for moving said carriers along the length of said headrail.

30. The system of claim 29 wherein said carriers are interconnected by linkage which establishes a maximum spacing between adjacent carriers.

31. The system of claim 30 wherein said linkage is a scissors-type linkage.

32. The system of claim 31 further including a lead carrier and wherein said lead carrier is connected to said another of said cords for movement by said another cord such that movement of the lead carrier affects following movement of the remaining carriers.

33. The system of claim 32 wherein said headrail is channel shaped so as to open upwardly and wherein a minority of each carrier is disposed within said hollow interior of the headrail.

34. The system of claim 33 wherein said linkage is mounted and interconnected with said carriers on the top of the carriers and externally of said headrail.

35. The system of claim 27 wherein said headrail has a longitudinal center line and said hanger pins are offset from said center line.

36. The system of claim 27 wherein said hanger pin is removably mounted.

37. The system of claim 27 wherein said carriers are slidably movable along the headrail.

38. The system of claim 37 wherein said headrail is made of painted aluminum and said carriers are made of Celcon®.

39. A vertical blind control system adapted to support a plurality of vertically suspended vanes, said control system comprising in combination:

a headrail of channel shaped configuration opening upwardly through an open top, said headrail having a vertical height under 0.6 inches, a plurality of carriers, only a minority portion of which are confined within the headrail, mounted on said headrail and being selectively moveable along its length, each carrier adapted to support a vane for pivotal movement about a vertical axis, and an operating system operatively connected to said carriers for selectively moving the carriers along the length of the headrail and adapted to selectively pivot said vanes.

40. The system of claim 39 wherein said carriers are partially positioned in said channel shaped headrail but protrude upwardly through the open top.

41. The system of claim 40 wherein said headrail has a longitudinal center line and said carriers extend beyond a side of said headrail and suspend said vanes from a position off center of the longitudinal center line of said headrail.

* * * * *